US008100202B2

(12) United States Patent
Durairajan et al.

(10) Patent No.: US 8,100,202 B2
(45) Date of Patent: Jan. 24, 2012

(54) FIXED CUTTER BIT WITH BACKUP CUTTER ELEMENTS ON SECONDARY BLADES

(75) Inventors: Bala Durairajan, Houston, TX (US); Carl M. Hoffmaster, Houston, TX (US); Michael G. Azar, The Woodlands, TX (US); Kurt T. Bush, Katy, TX (US)

(73) Assignee: Smith International, Inc., Houston, TX (US)

( * ) Notice: Subject to any disclaimer, the term of this patent is extended or adjusted under 35 U.S.C. 154(b) by 174 days.

(21) Appl. No.: 12/416,202

(22) Filed: Apr. 1, 2009

(65) Prior Publication Data

US 2009/0266619 A1 Oct. 29, 2009

Related U.S. Application Data

(60) Provisional application No. 61/041,375, filed on Apr. 1, 2008.

(51) Int. Cl.
*E21B 10/26* (2006.01)

(52) U.S. Cl. ..... 175/426; 175/431

(58) Field of Classification Search ..... 175/426, 175/431

See application file for complete search history.

(56) References Cited

U.S. PATENT DOCUMENTS

| | | | |
|---|---|---|---|
| 3,158,216 | A | 11/1964 | Baron et al. |
| 3,344,870 | A | 10/1967 | Morris |
| 4,140,189 | A | 2/1979 | Garner |
| 4,167,980 | A | 9/1979 | Saxman |
| 4,351,401 | A | 9/1982 | Fielder |
| 4,444,281 | A | 4/1984 | Schumacher, Jr. et al. |
| 4,471,845 | A | 9/1984 | Jurgens |
| 4,591,008 | A | 5/1986 | Oliver |
| 4,602,691 | A | 7/1986 | Weaver |
| 4,832,136 | A | 5/1989 | Mattsson et al. |
| 4,932,484 | A | 6/1990 | Warren et al. |
| 4,936,398 | A | 6/1990 | Auty et al. |
| 4,991,670 | A | 2/1991 | Fuller et al. |
| 5,010,783 | A | 4/1991 | Sparks et al. |

(Continued)

FOREIGN PATENT DOCUMENTS

EP 1096103 5/2001

(Continued)

OTHER PUBLICATIONS

Notice of Allowance and Fee(s) Due dated Dec. 15, 2009 for U.S. Appl. No. 11/760,933 (8 p.).

(Continued)

*Primary Examiner* — William P Neuder

(57) ABSTRACT

In an embodiment, a drill bit for drilling a borehole comprises a bit body having a bit axis and a bit face. In addition, the drill bit comprises a primary blade extending radially along the bit face. Further, the drill bit comprises a plurality of primary cutter elements mounted to the primary blade. The primary blade is free of backup cutter elements. Still further, the drill bit comprises a secondary blade extending radially along the bit face. Moreover, the drill bit comprises a plurality of primary cutter elements mounted to the secondary blade. In addition, the drill bit comprises a first plurality of backup cutter elements mounted to the secondary blade in a first backup row that trails the primary row. Further, the drill bit comprises a second plurality of backup cutter elements mounted to the secondary blade in a second backup row that trails the first backup row.

76 Claims, 13 Drawing Sheets

U.S. PATENT DOCUMENTS

| | | | | |
|---|---|---|---|---|
| 5,064,007 | A | 11/1991 | Kaalstad | |
| 5,074,367 | A | 12/1991 | Estes | |
| 5,099,929 | A | 3/1992 | Keith et al. | |
| 5,109,935 | A | 5/1992 | Hawke | |
| 5,145,016 | A | 9/1992 | Estes | |
| 5,145,017 | A | 9/1992 | Holster et al. | |
| 5,186,268 | A | 2/1993 | Clegg | |
| 5,222,566 | A | 6/1993 | Taylor et al. | |
| 5,238,075 | A | 8/1993 | Keith et al. | |
| 5,244,039 | A | 9/1993 | Newton, Jr. et al. | |
| 5,289,889 | A | 3/1994 | Gearhart et al. | |
| 5,407,024 | A | 4/1995 | Watson et al. | |
| 5,456,141 | A | 10/1995 | Ho | |
| 5,494,123 | A | 2/1996 | Nguyen | |
| 5,531,281 | A | 7/1996 | Murdock | |
| 5,549,171 | A | 8/1996 | Mensa-Wilmot et al. | |
| 5,551,522 | A | 9/1996 | Keith et al. | |
| 5,553,581 | A | 9/1996 | Hirabayashi et al. | |
| 5,553,681 | A | 9/1996 | Huffstutler et al. | |
| 5,575,301 | A | 11/1996 | Bolton | |
| 5,582,261 | A | 12/1996 | Keith et al. | |
| 5,592,996 | A | 1/1997 | Keith et al. | |
| 5,607,024 | A | 3/1997 | Keith et al. | |
| 5,607,025 | A | 3/1997 | Mensa-Wilmot et al. | |
| 5,608,162 | A | 3/1997 | Ho | |
| 5,651,421 | A | 7/1997 | Newton et al. | |
| 5,697,462 | A | 12/1997 | Grimes et al. | |
| 5,709,278 | A | 1/1998 | Crawford | |
| 5,746,280 | A | 5/1998 | Scott et al. | |
| 5,755,301 | A | 5/1998 | Love et al. | |
| 5,803,196 | A | 9/1998 | Fielder | |
| 5,816,346 | A | 10/1998 | Beaton | |
| 5,839,526 | A | 11/1998 | Cisneros et al. | |
| 5,862,871 | A | 1/1999 | Curlett | |
| 5,890,550 | A | 4/1999 | Swadi et al. | |
| 5,937,958 | A | 8/1999 | Mensa-Wilmot et al. | |
| 5,979,577 | A | 11/1999 | Fielder | |
| 5,996,713 | A | 12/1999 | Pessier et al. | |
| 6,021,859 | A | 2/2000 | Tibbitts et al. | |
| 6,123,160 | A | 9/2000 | Tibbitts | |
| 6,123,161 | A | 9/2000 | Taylor | |
| 6,164,394 | A | 12/2000 | Mensa-Wilmot et al. | |
| 6,173,797 | B1 | 1/2001 | Dykstra et al. | |
| 6,227,314 | B1 | 5/2001 | Zadrapa et al. | |
| 6,283,233 | B1 | 9/2001 | Lamine et al. | |
| 6,308,790 | B1 | 10/2001 | Mensa-Wilmot et al. | |
| 6,349,780 | B1 | 2/2002 | Beuershausen | |
| 6,408,958 | B1 | 6/2002 | Isbell et al. | |
| 6,427,792 | B1 | 8/2002 | Roberts et al. | |
| 6,481,511 | B2 | 11/2002 | Matthias et al. | |
| 6,536,543 | B2 | 3/2003 | Meiners et al. | |
| 6,575,256 | B1 | 6/2003 | Doster | |
| 6,615,934 | B2 | 9/2003 | Mensa-Wilmot | |
| 6,659,199 | B2 | 12/2003 | Swadi | |
| 6,688,410 | B1 | 2/2004 | Singh et al. | |
| 6,711,969 | B2 | 3/2004 | Meiners et al. | |
| 6,834,733 | B1 | 12/2004 | Maouche et al. | |
| 6,883,623 | B2 | 4/2005 | McCormick et al. | |
| 7,025,156 | B1 | 4/2006 | Caraway | |
| 7,278,499 | B2 | 10/2007 | Richert et al. | |
| 7,621,348 | B2 * | 11/2009 | Hoffmaster et al. | 175/376 |
| 7,726,415 | B1 | 6/2010 | Tipton et al. | |
| 2002/0020565 | A1 | 2/2002 | Hart et al. | |
| 2002/0121393 | A1 | 9/2002 | Thigpen et al. | |
| 2006/0162968 | A1 | 7/2006 | Durairajan et al. | |
| 2006/0185901 | A1 | 8/2006 | Sinor et al. | |
| 2006/0201718 | A1 | 9/2006 | Kembaiyan et al. | |
| 2006/0260845 | A1 | 11/2006 | Johnson | |
| 2007/0079995 | A1 | 4/2007 | McClain et al. | |
| 2007/0093996 | A1 | 4/2007 | Cariveau et al. | |
| 2007/0240905 | A1 | 10/2007 | Mensa-Wilmot | |
| 2007/0261890 | A1 * | 11/2007 | Cisneros | 175/331 |
| 2007/0272445 | A1 | 11/2007 | Cariveau et al. | |
| 2008/0135297 | A1 | 6/2008 | Gavia | |
| 2008/0164071 | A1 | 7/2008 | Patel et al. | |
| 2008/0179106 | A1 | 7/2008 | Gavia | |
| 2008/0179107 | A1 | 7/2008 | Doster | |
| 2008/0179108 | A1 * | 7/2008 | McClain et al. | 175/431 |
| 2009/0145669 | A1 * | 6/2009 | Durairajan et al. | 175/431 |
| 2009/0301789 | A1 * | 12/2009 | Smith et al. | 175/374 |
| 2010/0000800 | A1 | 1/2010 | Chen et al. | |

FOREIGN PATENT DOCUMENTS

| | | |
|---|---|---|
| GB | 2294712 | 5/1996 |
| GB | 2301852 | 12/1996 |
| GB | 2309242 | 7/1997 |
| GB | 2317195 | 3/1998 |
| GB | 2329203 | 3/1999 |
| GB | 2349661 | 8/2000 |
| GB | 2357534 | 6/2001 |
| GB | 2378718 | 2/2003 |
| GB | 2393982 | 4/2004 |
| GB | 2417967 | 3/2006 |
| GB | 2438053 | 11/2007 |
| GB | 2450222 | 12/2008 |
| GB | 2471020 A | 5/2011 |
| WO | 2007098159 | 8/2007 |
| WO | 2008073309 | 6/2008 |

OTHER PUBLICATIONS

Office Action dated Jun. 23, 2009 for U.S. Appl. No. 11/760,933 (17 p.).

Response to Office Action dated Jun. 23, 2009 for U.S. Appl. No. 11/760,933 (20 p.).

Final Office Action dated Oct. 23, 2009 for U.S. Appl. No. 11/760,933 (11 p.).

Request for Continued Examination and Response to Final Office Action dated Jan. 23, 2009 for U.S. Appl. No. 11/760,933 (21 p.).

Response to UK Examination Report Jul. 30, 2008 for Appl. No. 0810112.3 (73 p.).

Examination Report dated Dec. 18, 2009 for Appl. No. 0810112.3 (1 p.).

Combined Search and Examination Report dated Nov. 26, 2009 for Appl. No. 0913701.9 (38 p.).

Response to Combined Search and Examination Report dated Nov. 26, 2009 for Appl. No. 0913701.9 (37 p.).

Response to Examination Report dated Feb. 15, 2010 for Appl. No. 0822293.7 (8 p.).

Examination Report dated Feb. 15, 2010 for U.S. Appl. No. 0822293.7 (3 p.).

Response to Combined Search and Examination Report dated Apr. 21, 2009 for Appl. No. 0822293.7 (33 p.).

Response to Examination Report dated Jan. 23, 2008 for Appl. No. 0719244.6 (14 p.).

Response to Examination Report dated Feb. 11, 2009 for Appl. No. 0821536.0 (9 p.).

Baker Hughes Christenson; Quantec Performance Update; 2008 (pp. 10).

Baker Hughes Christensen; Quantec Brochure, 2008; (pp. 8).

Halliburton; Drilling, Evaluation and Gidital Solutions; Security DBS DrillBits; 2007; (pp. 2).

Office Action Dated Jan. 24, 2008 for U.S. Appl. No. 11/382,510; (20 p.).

Response to Office action Dated Jan. 24, 2008 for U.S Appl. No. 11/382,510; (18 p.).

Final Office Action Dated Aug. 25, 2008 for U.S. Appl. No. 11/382,510; (9 p.).

Response to Final Office Action Dated Aug. 25, 2008 for U.S. Appl. No. 11/382,510; (15 p.).

Office Action Dated Feb. 10, 2009 for U.S. Appl. No. 11/382,510; (12 p.).

Office Action dated Jul. 9, 2008 for U.S. Appl. No. 11/760,933; (16 p.).

Response to Office Action Dated Jul. 9, 2008 for U.S. Appl. No. 11/760,933; (25 p.).

Final Office Action Dated Jan. 23, 2009 for U.S. Appl. No. 11/760,933; (24 p.).

Response to Final Office Action Dated Jan. 23, 2009 for U.S. Appl. No. 11/760,933; (19 p.).

Office Action Dated Oct. 30, 2008 for U.S. Appl. No. 11/866,333; (13 p.).

Advisory Action Dated Apr. 2, 2009 for U.S. Appl. No. 11/760,933; (3 p.).
Response to Office Action Dated Oct. 30, 2008 for U.S. Appl. No. 11/866,333; (22 p.).
Notice of Allowance and Fee(s) Due dated Apr. 21, 2009 for U.S. Appl. No. 11/866,333; (10 p.).
Canadian Office Action dated Mar. 9, 2009 for Appl. No. 2,587,287; (3 p.).
Combined Search and Examination Report for Appl. No. GB0708446.0 dated Aug. 9, 2007; (2 p.).
Examination Report for Appl. No. GB0708446.0 dated Nov. 14, 2008; (2 p.).
Combined Search and Examination Report for Appl. No. GB0810112.3 dated Jul. 29, 2008; (4 p.).
Combined Search and Examination Report for Appl. No. GB0822293.7 dated Apr. 17, 2009; (4 p.).
Combined Search and Examination Report for Appl. No. GB0821536.0 dated Feb. 11, 2009; (2 p.).
Combined Search and Examination Report for Appl. No. GB0719244.6 dated Jan. 23, 2008; (3 p.).
PCT International Search Report and Written Opinion dated Oct. 28, 2009 for Appl. No. PCT/US2009/039154; (6 p.).
Baker Hughes Christensen; Quantec Bit; 2008 (p. 1).
Baker Hughes Christensen; Quantec; Premium PDC drill bits; 2008 (p. 1).
Non-Final Office Action dated Sep. 28, 2010, for related U.S. Appl. No. 12/329,163, filed Dec. 5, 2008.
Response filed Dec. 28, 2010, to Non-Final Office Action dated Sep. 28, 2010, for related U.S. Appl. No. 121329,163, filed Dec. 5, 2008.
Final Office Action dated Mar. 18, 2011, for related U.S. Appl. No. 12/329,163, filed Dec. 5, 2008.
Response filed May 18, 2011, to Final Office Action dated Mar. 18, 2011, for related U.S. Appl. No. 12/329,163, filed Dec. 5, 2008.
Advisory Action dated Jun. 16, 2011, for related U.S. Appl. No. 12/329,163, filed Dec. 5, 2008.

* cited by examiner

FIXED CUTTER BIT WITH BACKUP CUTTER ELEMENTS ON SECONDARY BLADES

CROSS-REFERENCE TO RELATED APPLICATIONS

This application claims benefit of U.S. provisional application Ser. No. 61/041,375 filed Apr. 1, 2008, and entitled "Fixed Cutter Bit with Backup Cutter Elements on Secondary Blades," which is hereby incorporated herein by reference in its entirety for all purposes.

STATEMENT REGARDING FEDERALLY SPONSORED RESEARCH OR DEVELOPMENT

Not Applicable.

BACKGROUND

1. Field of the Invention

The invention relates generally to earth-boring drill bits used to drill a borehole for the ultimate recovery of oil, gas, or minerals. More particularly, the invention relates to fixed cutter bits and to an improved cutting structure for such bits. Still more particularly, the present invention relates to fixed cutter bits with backup cutter elements on secondary blades.

2. Background of the Technology

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominate types of rock bits are roller cone bits and fixed cutter (or rotary drag) bits. Some fixed cutter bit designs include primary blades, secondary blades, and sometimes even tertiary blades, angularly spaced about the bit face, where the primary blades are generally longer and start at locations closer to the bit's central axis. The blades project radially outward from the bit axis and form flow channels there between. In addition, cutter elements are often grouped and mounted on several blades. The configuration or layout of the cutter elements on the blades may vary widely, depending on a number of factors. One of these factors is the formation itself, as different cutter layouts cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. A cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PCD bit" or "PCD cutting element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thus reducing cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutting elements in order to prolong cutting element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Thus, it is always desirable to employ drill bits which will drill faster and longer, and which are usable over a wider range of formation hardness.

Accordingly, there remains a need in the art for a fixed cutter bit and cutting structure capable of enhanced ROP and greater bit life, while minimizing other detrimental effects. Such a fixed cutter bit would be particularly well received if it included an increased cutter element surface area while maintaining sufficient bit hydraulics.

BRIEF SUMMARY OF SOME OF THE PREFERRED EMBODIMENTS

These and other needs in the art are addressed in one embodiment by a drill bit for drilling a borehole in earthen formations. In an embodiment, the drill bit comprises a bit body having a bit axis and a bit face including a cone region, a shoulder region, and a gage region. In addition, the drill bit comprises a primary blade extending radially along the bit face from the cone region through the shoulder region to the gage region. Further, the drill bit comprises a plurality of primary cutter elements mounted to the primary blade in a primary row. The primary blade is free of backup cutter elements. Still further, the drill bit comprises a secondary blade extending radially along the bit face from the shoulder region to the gage region. Moreover, the drill bit comprises a plurality of primary cutter elements mounted to the secondary blade in a primary row. In addition, the drill bit comprises a first plurality of backup cutter elements mounted to the secondary blade in a first backup row that trails the primary row. Further, the drill bit comprises a second plurality of backup cutter elements mounted to the secondary blade in a second backup row that trails the first backup row.

These and other needs in the art are addressed in another embodiment by a drill bit for drilling a borehole in earthen formations. In an embodiment, the drill bit comprises a bit body having a bit axis and a bit face including a cone region, a shoulder region, and a gage region. In addition, the drill bit comprises a primary blade extending radially along the bit face from the cone region through the shoulder region to the gage region. Further, the drill bit comprises a plurality of primary cutter elements mounted to the primary blade. Still further, the drill bit comprises a secondary blade extending along the bit face from the shoulder region to the gage region. Moreover, the drill bit comprises a plurality of primary cutter elements mounted to the secondary blade. In addition, the drill bit comprises a plurality of backup cutter elements mounted to the secondary blade. Each primary cutter element includes a forward facing primary cutting face and each backup cutter element includes a forward facing backup cutting face. Each primary cutting face has a primary face surface area and each backup cutting face has a backup face surface area. The total backup face surface area on the secondary blade is greater than the total backup face surface area on the primary blade.

These and other needs in the art are addressed in another embodiment by a drill bit for drilling a borehole in earthen formations. In an embodiment, the drill bit comprises a bit body having a bit axis and a bit face including a cone region, a shoulder region, and a gage region. In addition, the drill bit comprises a primary blade extending radially along the bit face from the cone region through the shoulder region to the gage region. Further, the drill bit comprises a plurality of primary cutter elements mounted to the primary blade arranged in a primary row. Still further, the drill bit comprises a plurality of backup cutter elements mounted to the primary blade. The backup cutter elements are arranged to consist essentially of a single backup row that trails the primary row. Moreover, the drill bit comprises a secondary blade extending along the bit face from the shoulder region to the gage region. In addition, the drill bit comprises a plurality of primary cutter elements mounted to the secondary blade arranged in a primary row. Further, the drill bit comprises a first plurality of backup cutter elements mounted to the secondary blade. The first plurality of backup cutter elements are arranged in a first backup row that trails the primary row. Still further, the drill bit comprises a second plurality of backup cutter elements mounted to the secondary blade. The second plurality of backup cutter elements are arranged in a second backup row that trails the first backup row.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the preferred embodiments, reference will now be made to the accompanying drawings, wherein.

DETAILED DESCRIPTION OF THE PREFERRED EMBODIMENTS

Figure 1:
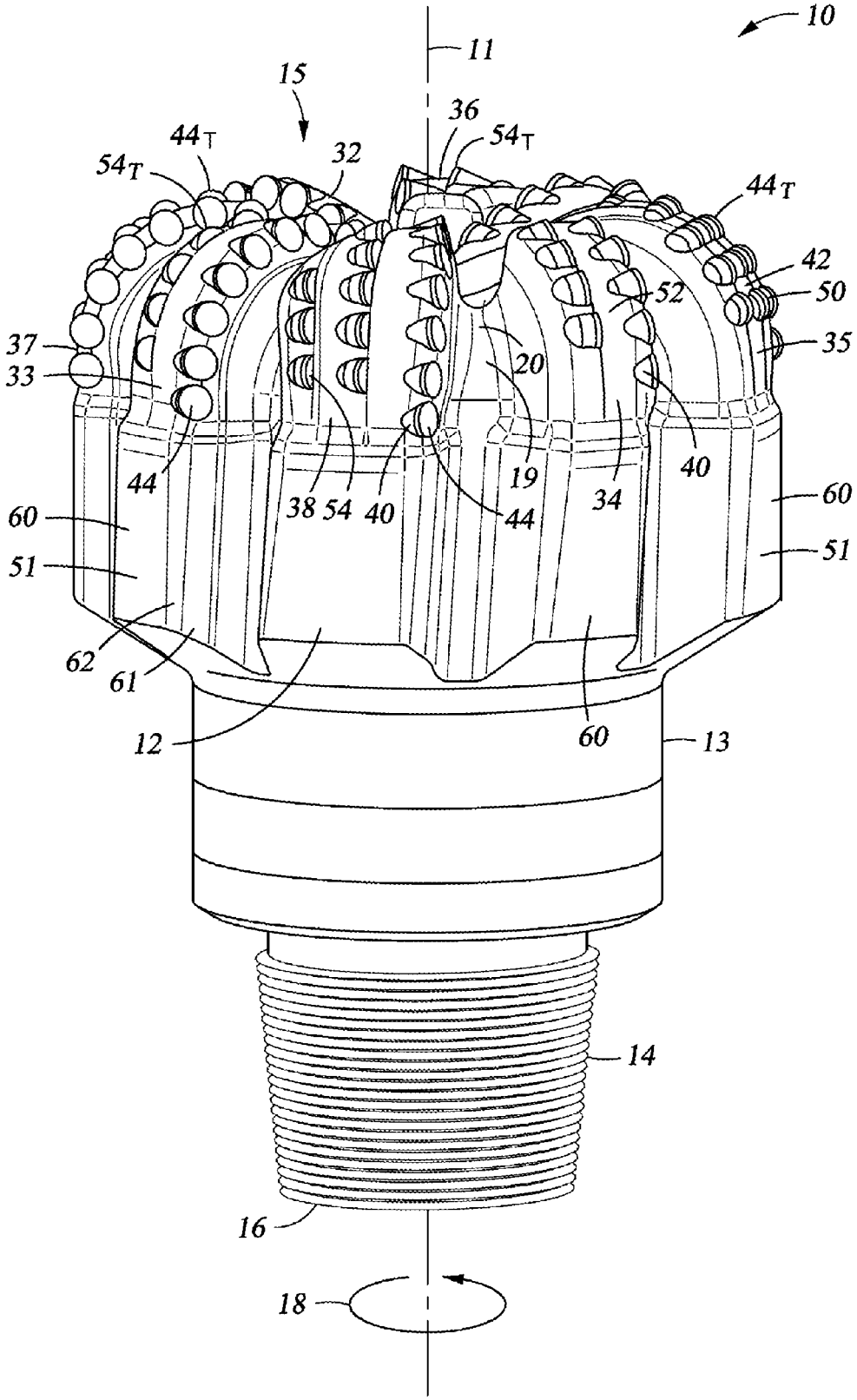
FIG. 1 is a perspective view of an embodiment of a bit made in accordance with the principles described herein.

The following discussion is directed to various embodiments of the invention. The embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

Figure 2:
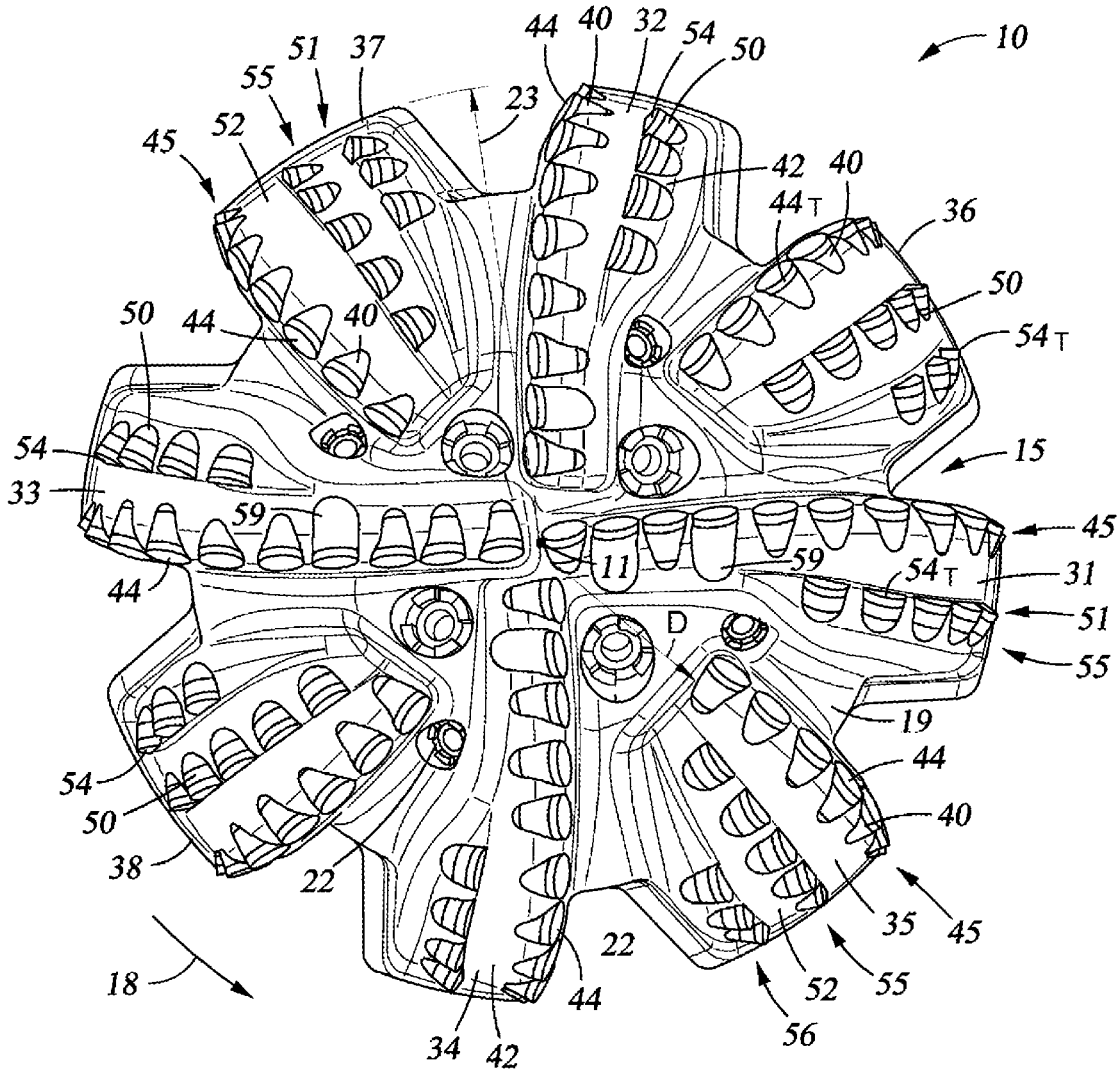
FIG. 2 is a top view of the bit shown in FIG. 1.
Figure 4:
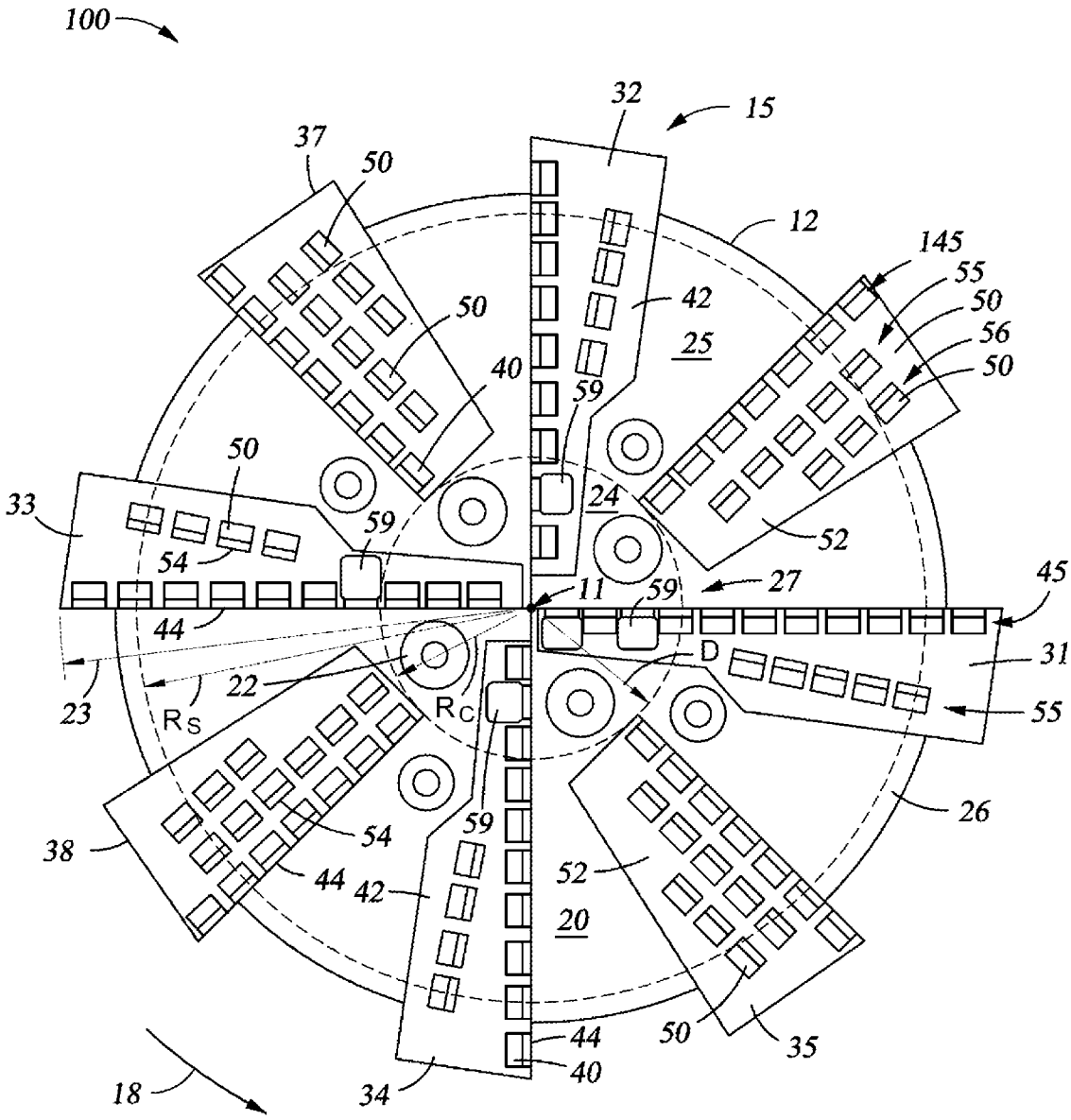
FIG. 4 is a schematic top view of the bit shown in FIG. 1.

Referring to FIGS. 1, 2, and 4, exemplary bit 10 is a fixed cutter bit, sometimes referred to as a drag bit, and is preferably a PCD bit adapted for drilling through formations of rock to form a borehole. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18. As used herein, the terms "axial" and "axially" generally mean along or parallel to the bit axis (e.g., bit axis 11), while the terms "radial" and "radially" generally mean perpendicular to the bit axis. For instance, an axial distance refers to a distance measured along or parallel to the bit axis, and a radial distance means a distance measured perpendicular to the bit axis.

Body 12 may be formed in a conventional manner using powdered metal tungsten carbide particles in a binder material to form a hard metal cast matrix. Alternatively, the body can be machined from a metal block, such as steel, rather than being formed from a matrix.

Figure 3:
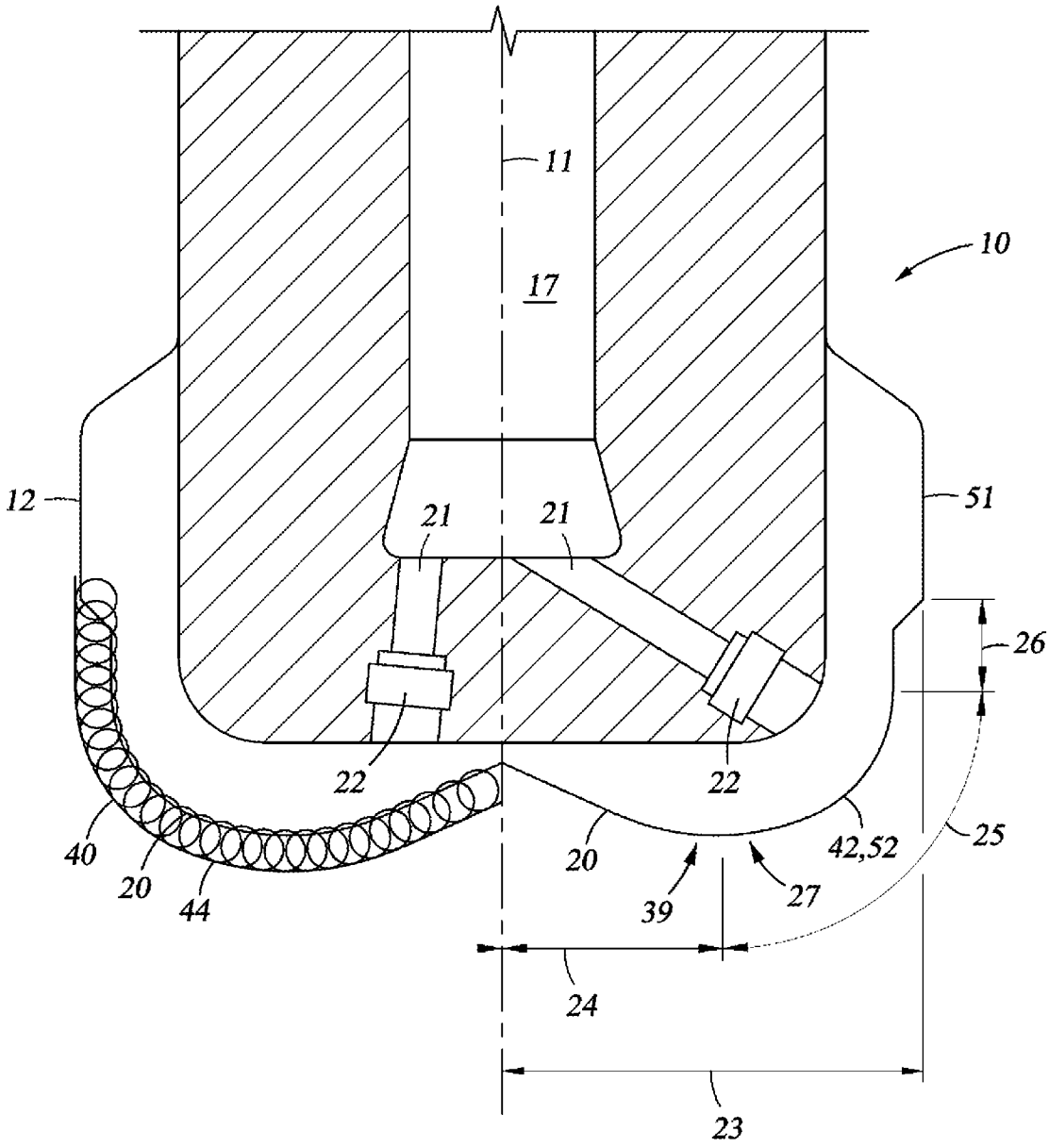
FIG. 3 is a partial cross-sectional view of the bit shown in FIG. 1 with the blades and select the primary cutter elements of the bit shown rotated into a single profile

As best seen in FIG. 3, body 12 includes a central longitudinal bore 17 permitting drilling fluid to flow from the drill string into bit 10. Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around cutting structure 15 to flush away formation cuttings during drilling and to remove heat from bit 10.

Referring again to FIGS. 1, 2, and 4, cutting structure 15 is provided on face 20 of bit 10. Cutting structure 15 includes a plurality of blades which extend along bit face 20. In the embodiment illustrated in FIGS. 1 and 2, cutting structure 15 includes four angularly spaced-apart primary blades 31, 32, 33, 34 and four angularly spaced apart secondary blades 35, 36, 37, 38. In particular, in this embodiment, the plurality of blades (e.g., primary blades 31, 32, 33, 34 and secondary blades 35, 36, 37, 38) are uniformly angularly spaced on bit face 20 about bit axis 11. Namely, blades 31-38 are uniformly angularly spaced about 45° apart. Further, primary blades 31, 32, 33, 34 and secondary blades 35, 36, 37, 38 are circumferentially arranged in an alternating fashion. In other words, one secondary blade 35, 36, 37, 38 is circumferentially disposed between each pair of circumferentially adjacent primary blades 31, 32, 33, 34. For example, secondary blade 35 is circumferentially positioned between circumferentially adjacent primary blades 31, 34. Accordingly, four primary blades 31, 32, 33, 34 are uniformly angularly spaced about 90° apart, and the four secondary blades 35, 36, 37, 38 are uniformly angularly spaced about 90° apart. In other embodiments, one or more of the blades (e.g., primary blade, secondary blade, tertiary blade, etc.) may be spaced non-uniformly about the bit face (e.g., bit face 20). Although bit 10 is shown as having four primary blades 31, 32, 33, 34 and four secondary blades 35, 36, 37, 38, other embodiments of bits designed in accordance with the principles described herein may comprise any suitable number of primary, secondary blades, tertiary blades, or combinations thereof. As one example only, a bit may comprise three primary blades and three secondary blades.

In this embodiment, primary blades 31, 32, 33, 34 and secondary blades 35, 36, 37, 38 are integrally formed as part of, and extend along, bit body 12 and bit face 20. Primary blades 31, 32, 33, 34 and secondary blades 35, 36, 37, 38 extend generally radially along bit face 20 (relative to bit axis 11 and then axially (relative to bit axis 11) along a portion of the periphery of bit 10. In particular, primary blades 31, 32, 33, 34 extend radially from proximal central axis 11 toward the periphery of bit 10. Thus, as used herein, the term "primary blade" refers to a blade that begins proximal the bit axis (e.g., bit axis 11) and extends generally radially outward along the bit face to the periphery of the bit. However, secondary blades 35, 36, 37, 38 are not positioned proximal bit axis 11. Rather, as best seen in FIGS. 2 and 4, secondary blades 35-38 extend radially from a location that is a distance "D" away from central axis 11 toward the periphery of bit 10. Hence, primary blades 31, 32, 33, 34 extend closer to central axis 11 than secondary blades 35, 36, 37, 38. Thus, as used herein, the term "secondary blade" refers to a blade that begins at some distance from the bit axis and extends generally radially along the bit face to the periphery of the bit. Primary blades 31, 32, 33, 34 and secondary blades 35, 36, 37, 38 are separated by drilling fluid flow courses 19.

Referring still to FIGS. 1, 2, and 4, each primary blade 31, 32, 33, 34 includes a cutter-supporting surface 42 for mounting a plurality of cutter elements, and each secondary blade 35, 35, 37, 38 includes a cutter-supporting surface 52 for mounting a plurality of cutter elements. A plurality of primary cutter elements 40, each having a primary cutting face 44, are mounted to each primary blade 31, 32, 33, 34, and mounted to each secondary blade 35, 35, 37, 38. In addition, a plurality of backup cutter elements 50, each having a backup cutting face 54, are mounted to each primary blade 31, 32, 33, 34 and to each secondary blade 35, 35, 37, 38. Each cutting face 44, 54 has an outermost cutting tip $\mathbf{44}_T$, $\mathbf{54}_T$, respectively, positioned furthest from cutter-supporting surface 42, 52 to which it is mounted (as measured perpendicularly from its respective cutter-supporting surface 42, 52). As will be described in more detail below, in other embodiments, no backup cutter elements (e.g., backup cutter elements 50) are provided on the primary blades (e.g., primary blades 31, 32, 33, 34).

As best seen in FIGS. 2 and 4, when bit 10 rotates about central axis 11 in the cutting direction represented by arrow 18, primary cutter elements 40 lead or precede each backup cutter element 50 provided on the same blade 31-38. Thus, as used herein, the phrase "backup cutter element" refers to a cutter element that is disposed behind or trails another cutter element disposed on the same blade when the bit (e.g., bit 10) is rotated in the cutting direction (e.g., cutting direction 18) about its axis (e.g., bit axis 11). Further, as used herein, the term "primary cutter element" refers to a cutter element that is not disposed behind and does not trail any other cutter elements on the same blade when the bit is rotated in the cutting direction about its axis.

Primary cutter elements 40 are arranged adjacent one another in a leading or primary row 45 extending radially along the leading edge of each primary blade 31, 32, 33, 34 and along the leading edge of each secondary blade 35, 35, 37, 38. Backup cutter elements 50 on each primary blade 31, 32, 33, 34 are arranged adjacent one another in a single trailing or backup row 55 extending radially along each primary blade 31, 32, 33, 34. Further, a first set or plurality of backup cutter elements 50 on each secondary blade 35, 36, 37, 38 are arranged adjacent one another in a first trailing or backup row 55, and a second set or plurality of backup cutter elements 50 on each secondary blade 35, 36, 37, 38 are arranged adjacent one another in a second trailing or backup row 56. On each primary blade 31, 32, 33, 34, backup row 55 trails primary row 45. Further, on each secondary blade 35, 36, 37, 38, first backup row 55 trails primary row 45, and second backup row 56 trails first backup row 55. Thus, primary blades 31, 32, 33, 34 may be described as comprising two rows of cutter elements—a leading row 45 of primary cutter elements 40 and a trailing row 55 of backup cutter elements 50. Further, secondary blades 35, 36, 37, 38 may be described as comprising three rows of cutter elements—a leading row 45 of primary cutter elements 40, a first trailing row 55 of backup cutter elements 50, and a second trailing row 56 of backup cutter elements 50.

Although primary cutter elements 40 and backup cutter elements 50 are shown as being arranged in rows, primary cutter elements 40 and/or backup cutter elements 50 may be mounted in other suitable arrangements provided each primary cutter element is in a leading position and each backup cutter element is in a trailing position. Examples of suitable arrangements may include without limitation, rows, arrays or organized patterns, randomly, sinusoidal pattern, or combinations thereof. In other embodiments, additional rows of cutter elements (e.g., a tertiary row) may be provided on one or more primary blade(s), secondary blade(s), or combinations thereof.

In this embodiment, a depth-of-cut limiter 59 is provided on each primary blade 31-34 behind select primary cutter elements 40. In particular, each depth-of-cut limiter 59 is associated with and disposed at the same radial position as a particular primary cutter element 40. Depth-of-cut limiter 59 is intended to slide across the formation, thereby limiting the depth to which its associated primary cutter element 40 penetrates the formation and also limiting the cutting loads experienced by its associated primary cutter element 40. As a result, depth-of-cut limiter 59 offers the potential to protect and reduce the likelihood of premature damage and/or breakage of its associated primary cutter element 40. In this embodiment, depth-of-cut limiter 59 is not an insert or stud secured in a mating socket mounted to each primary blade 31-34. Rather, in this embodiment, each depth-of-cut limiter 59 is integral with the primary blade 31-34 to which it is mounted, and thus, may be referred to as an "integral depth-of-cut limiter." For example, depth-of-cut limiter 59 may be formed from or milled from the matrix making up bit body 12. Although depth-of-cut limiters 59 are integral depth-of-cut limiters, in other embodiments, the depth-of-cut limiters may comprise a cylindrical stud secured in a mating socket in its respective cutter-supporting surface. A generally dome-shaped end of each depth-of-cut limiter extends generally perpendicularly from the cutter-supporting surface. The depth-of-cut limiters are generally intended to limit the maximum depth-of-cut of the cutting faces as they engage the formation. It should be appreciated that the depth-of-cut limiters may have any suitable geometry and are not strictly limited to dome-shaped studs.

Referring again to FIGS. 1 and 2, bit 10 further includes gage pads 51 of substantially equal axial length. Gage pads 51 are disposed about the circumference of bit 10 at angularly spaced locations. Specifically, gage pads 51 intersect and extend from each blade 31-38. Gage pads 51 are integrally formed as part of the bit body 12.

Each gage pad 51 includes a generally gage-facing surface 60 and a generally forward-facing surface 61 which intersect in an edge 62, which may be radiused, beveled or otherwise rounded. Gage-facing surface 60 includes at least a portion that extends in a direction generally parallel to bit access 11 and extends to full gage diameter. In some embodiments, other portions of gage-facing surface 60 may be angled, and thus slant away from the borehole sidewall. Also, in select embodiments, forward-facing surface 61 may likewise be angled relative to central axis 11 (both as viewed perpendicular to central axis 11 or as viewed along central axis 11). Surface 61 is termed generally "forward-facing" to distinguish that surface from the gage surface 60, which generally faces the borehole sidewall. Gage-facing surface 60 of gage pads 51 abut the sidewall of the borehole during drilling. The pads can help maintain the size of the borehole by a rubbing action when primary cutter elements 40 wear slightly under gage. The gage pads also help stabilize the bit against vibration. In other embodiments, one or more of the gage pads (e.g., gage pads 51) may include other structural features. For instance, wear-resistant cutter elements or inserts may be embedded in gage pads and protrude from the gage-facing surface or forward-facing surface.

Referring now to FIG. 3, an exemplary profile of bit 10 is shown as it would appear with all blades (e.g., primary blades 31, 32, 33, 34 and secondary blades 35, 36, 37, 38) and select primary cutter elements 40 rotated into a single rotated profile. Some primary cutter elements 40 and backup cutter elements 50 are not shown in this view for clarity purposes.

In rotated profile view, the blades of bit 10 form a combined or composite blade profile 39 generally defined by cutter-supporting surfaces 42, 52 of each blade. Composite blade profile 39 and bit face 20 may generally be divided into three regions conventionally labeled cone region 24, shoulder region 25, and gage region 26. Cone region 24 comprises the radially innermost region of bit 10 and composite blade profile 39 extending generally from bit axis 11 to shoulder region 25. In this embodiment, cone region 24 is generally concave. Adjacent cone region 24 is shoulder (or the upturned curve) region 25. In this embodiment, shoulder region 25 is generally convex. The transition between cone region 24 and shoulder region 25 occurs at the axially outermost portion of composite blade profile 39 (lowermost point on bit 10 in FIG. 3), which is typically referred to as the nose or nose region 27. Next to shoulder region 25 is the gage region 26 which extends substantially parallel to bit axis 11 at the outer radial periphery of composite blade profile 39. In this embodiment, gage pads 51 extend from each blade as previously described. As shown in composite blade profile 39, gage pads 51 define the outer radius 23 of bit 10. Outer radius 23 extends to and therefore defines the full gage diameter of bit 10. As used herein, the term "full gage diameter" is used to describe elements or surfaces extending to the full, nominal gage of the bit diameter.

Still referring to FIG. 3, cone region 24 may also be defined by a radial distance measured from, and perpendicular to, bit axis 11. The radial distance defining the bounds of cone region 24 may be expressed as a percentage of outer radius 23. In the embodiment shown in FIG. 3, cone region 24 extends from central axis 11 to about 50% of outer radius 23. In other embodiments, the cone region (e.g., cone region 24) extends from the bit axis (e.g., bit axis 11) to about 30% of the bit's outer radius (e.g., outer radius 23). Cone region 24 may likewise be defined by the location of one or more secondary blades (e.g., secondary blades 35, 36, 37, 38). In other words, the outer radial boundary of cone region 24 may coincide with the radius at which one or more secondary blades begin. It should be appreciated that the actual radius of the cone region of a bit (e.g., cone region 24) measured from the bit's axis (e.g., axis 11), may vary from bit to bit depending on a variety of factors including without limitation, bit geometry, bit type, location of one or more secondary blades, location of backup cutter elements, or combinations thereof. For instance, in some cases, bit 10 may have a relatively flat parabolic profile resulting in a cone region 24 that is relatively large (e.g., 50% of outer radius 23). However, in other cases, bit 10 may have a relatively long parabolic profile resulting in a relatively smaller cone region 24 (e.g., 30% of outer radius 23).

Referring now to FIG. 4, a schematic top view of bit 10 is illustrated. Moving radially outward from bit axis 11, bit face 20 includes cone region 24, shoulder region 25, and gage region 26 as previously described. Nose region 27 generally represents the transition between cone region 24 and shoulder region 25. Specifically, cone region 24 extends radially from bit axis 11 to a cone radius $R_c$, shoulder region 25 extends radially from cone radius $R_c$ to shoulder radius $R_s$, and gage region 26 extends radially from shoulder radius $R_s$ to bit outer radius 23.

Primary blades 31, 32, 33, 34 extend radially along bit face 20 from within cone region 24 proximal bit axis 11 toward gage region 26 and outer radius 23. In this embodiment, secondary blades 35, 36, 37, 38 extend radially along bit face 20 from proximal nose region 27 toward gage region 26 and outer radius 23. In other words, secondary blades 35, 36, 37, 38 do not extend significantly into cone region 24. Thus, secondary blades 35, 36, 37, 38 occupy little to no space on bit face 20 within cone region 24.

Although this embodiment shows secondary blades 35, 36, 37, 38 as extending slightly into cone region 24, in other embodiments, one or more secondary blades (e.g., secondary blades 35, 36, 37, 38) may begin at the cone radius (e.g., cone radius $R_c$) and extend toward gage region 26. In such embodiments, the one or more of the secondary blades may be used to define the cone region as described above (i.e., the cone region extends from the bit axis to the start of the secondary blades). In this embodiment, primary blades 31, 32, 33, 34 and secondary blades 35, 36, 37, 38 each extend substantially to gage region 26 and outer radius 23.

Referring still to FIG. 4, primary blades 31, 32, 33, 34 and secondary blades 35, 36, 37, 38 provide cutter-supporting surfaces 42, 52, respectively, for mounting cutter elements 40, 50 as previously described. In this embodiment, eleven primary cutter elements 40 arranged in primary row 45 are provided on primary blade 31; nine primary cutter elements 40 arranged in primary row 45 are provided on primary blade 32; ten primary cutter elements 40 arranged in primary row 45 are provided on primary blade 33; and ten primary cutter elements 40 arranged in primary row 45 are provided on primary blade 34. Further, seven primary cutter elements 40 arranged in primary row 45 provided on each secondary blade 35, 36, 37, 38. In other embodiments, the number of primary cutter elements (e.g., primary cutter elements 40) on each primary blade (e.g., primary blades 31, 32, 33, 34) and each secondary blade (e.g., secondary blades 35, 36, 37, 38) may differ.

In this embodiment, five backup cutter elements 50 arranged in backup row 55 are provided on primary blade 31, and four backup cutter elements 50 arranged in backup row 55 are provided on each primary blade 32, 33, 34. Further, five backup cutter elements 50 arranged in a first backup row 55 are provided on each secondary blade 35, 36, 37, 38, and three backup cutter elements 50 arranged in a second backup row 56 are provided on each secondary blade 35, 36, 37, 38.

Still referring to the embodiment shown in FIG. 4, each primary blade 31, 32, 33, 34 and each secondary blade 35, 36, 37, 38 generally tapers (e.g., becomes thinner) in top view as it extends radially inwards towards central axis 11. Consequently, primary blades 31, 32, 33, 34 are relatively thin proximal axis 11 where space is generally limited circumferentially, and widen towards gage region 26, thereby creating additional space to accommodate both primary cutter elements 40 and backup cutter elements 50 on the same primary blade. Likewise, secondary blades 35, 36, 37, 38 widen towards gage region 26, thereby creating additional space to accommodate both primary cutter elements 40 and backup cutter elements 50 on the same blade. Although primary blades 31, 32, 33, 34 and secondary blades 35, 36, 37, 38 illustrated in FIG. 4 extend substantially linearly in the radial direction in top view, in other embodiments, one or more of the primary blades, one or more secondary blades, or combinations thereof may be arcuate or curve along their length in top view.

Referring now to FIGS. 1, 2, and 4, each cutter element 40, 50 comprises an elongated and generally cylindrical support member or substrate which is received and secured in a pocket formed in the surface of the blade to which it is fixed. Cutting face 44, 54 of each cutter element 40, 50, respectively, comprises a cylindrical disk or tablet-shaped, hard cutting layer of polycrystalline diamond or other superabrasive material is bonded to the exposed end of the support member. In the embodiments described herein, each cutter element 40, 50 is mounted such that cutting faces 44, 54, respectively, are forward-facing. As used herein, "forward-facing" is used to describe the orientation of a surface that is generally perpendicular to or at an acute angle relative to the cutting direction of rotation of the bit to which it is mounted. For instance, a forward-facing cutting face 44, 54 may be oriented perpendicular to the cutting direction of bit 10 represented by arrow 18, may include a backrake angle, and/or may include a siderake angle. Cutting faces 44, 54 are preferably oriented perpendicular to the direction of rotation of bit 10 plus or minus a 30° backrake angle and plus or minus a 45° siderake angle. In addition, each cutting face 44, 54 includes a cutting edge adapted to engage and remove formation material via a shearing action. Such cutting edge may be chamfered or beveled as desired. In this embodiment, cutting faces 44, 54 are substantially planar, but may be convex or concave in other embodiments. Each cutting face 44, 54 preferably extends to or within 0.080 in. (~2.032 mm) of the outermost cutting profile of bit 10.

In the embodiment of bit 10 illustrated in FIG. 4, each cutter element 40, 50 has substantially the same size and geometry. As previously described, each cutter element 40, 50 is generally cylindrical and has a cylindrical cutting face 44, 54. However, in other embodiments, one or more primary cutter element (e.g., primary cutter element 40) and/or one or more backup cutter element (e.g., backup cutter element 50) may have a different size and/or geometry. For instance, each backup cutter element may have the same size and geometry, and each primary cutter element may have the same size and geometry that is different from each backup cutter elements. In general, each primary cutter element 40 and each backup cutter element 50 may have any suitable size and geometry.

Referring again to FIG. 4, the forward facing surface of each primary cutting face 44 has a primary face surface area, and each backup cutting face 54 has a backup face surface area. In general, for a circular cutting face (e.g., primary cutting face 44, backup cutting face 54) having a diameter d, the face surface area is calculated as follows:

$$A_{cutting\,face} = \pi \cdot \left(\frac{d}{2}\right)^2$$

For purposes of this disclosure, the entire cutting face surface area (e.g., primary cutting face surface area, backup cutting face surface area, etc.) is calculated even though only a portion of the cutting face may actually extend from the cutter-supporting surface (e.g., cutter supporting surface 42, 52) to which the cutting face is mounted.

The total backup face surface area on each secondary blade 35, 36, 37, 38 (i.e., the sum of the backup face surface areas of every backup cutting face 54 on each particular secondary blade 35, 36, 37, 38) is preferably greater than or equal to the total backup face surface area on each primary blade 31, 32, 33, 34 (i.e., the sum of the backup face surface areas of every backup cutting faces 54 on each particular primary blade 31, 32, 33, 34). In particular, the ratio of the total backup face surface area on each secondary blade 35, 36, 37, 38 to the total backup face surface area on each primary blade 31, 32, 33, 34 is preferably greater than or equal to 1.0, more preferably greater than or equal to 1.5, and even more preferably greater than or equal to 2.0. In this embodiment, primary blade 31 has five backup cutter elements 50, and remaining primary blades 32, 33, 34 each have four backup cutter elements 50. In addition, each secondary blade 35, 36, 37, 38 has eight backup cutter elements 50. Since each cutting face 54 has substantially the same geometry, the total backup face surface area on each secondary blade 35, 36, 37, 38 is greater than the total backup face surface area on each primary blade 31, 32, 33, 34—the backup face surface area of eight backup cutting faces 54 on each secondary blade 35-38 is greater than the backup face surface area of four or five backup cutting faces 54 on each primary blade 31-34. For an exemplary bit 10 having backup cutting faces 54 with a 16 mm (~0.625 in.) diameter, each backup cutting face 54 has a backup face surface area of about 200 $mm^2$ (~0.31 $in.^2$) (where backup face surface area=$\pi$*(16 mm/2)$^2$). Thus, for such an exemplary bit 10, the total backup face surface area on each secondary blade 35, 36, 37, 38 is about 1600 $mm^2$ (eight backup cutting faces 54 on each secondary blade 35-38 multiplied by 200 $mm^2$ per backup cutting face 54); the total backup face surface area on primary blade 31 is about 1000 $mm^2$ (five backup cutting faces 54 on primary blade 31 multiplied by 200 $mm^2$ per backup cutting face 54); and the total backup face surface area on each primary blade 32, 33, 34 is about 800 $mm^2$ (four backup cutting faces 54 on each primary blade 32, 33, 34 multiplied by 200 $mm^2$ per backup cutting face 54). Thus, in this embodiment, the ratio of the total backup face surface area on each secondary blade 35, 36, 37, 38 to the total backup face surface area on each primary 31 is about 1.6, and the ratio of the total backup face surface area on each secondary blade 35, 36, 37, 38 to the total backup face surface area on each primary 32-34 is about 2.0.

Further, the total backup face surface area on all secondary blades 35-38 (i.e., the sum of the backup face surface areas of all backup faces 54 on all secondary blades 35-38) is preferably greater than or equal to the total backup face surface area on all primary blades 31-34 (i.e., the sum of the backup face surface areas of all backup faces 154 on all primary blades 31-34). In particular, the ratio of the total backup face surface area on all secondary blades 35-38 to the total backup face surface area on all primary blades 31-34 is preferably greater than or equal to 1.0, more preferably greater than or equal to 1.5, and even more preferably greater than or equal to 2.0. In this embodiment, a total of seventeen backup cutter elements 50 are provided on all primary blades 31-34, and a total of thirty-two backup cutter elements 50 are provided on all secondary blades 35-38. Since each cutting face 54 has substantially the same geometry, the total backup face surface area on all secondary blades 35-38 is greater than the total backup face surface area on all primary blade 31-34. For an exemplary bit 10 having backup cutting faces 54 with a 16 mm (~0.625 in.) diameter, each backup cutting face 54 has a backup face surface area of about 200 $mm^2$ (~0.31 $in.^2$) (where backup face surface area=$\pi$*(16 mm/2)$^2$). Thus, for such an exemplary bit 10, the total backup face surface area on all secondary blades 35, 36, 37, 38 is about 6400 $mm^2$ (thirty-two backup cutting faces 54 on all secondary blade 35-38 multiplied by 200 $mm^2$ per backup cutting face 54); the total backup face surface area on all primary blades 31-34 is about 3400 $mm^2$ (seventeen backup cutting faces 54 on all primary blade 31-34 multiplied by 200 $mm^2$ per backup cutting face 54). Thus, in this embodiment, the ratio of the total backup face surface area on each secondary blade 35, 36, 37, 38 to the total backup face surface area on each primary 31 is about 1.88.

Still further, the total backup face surface area on each secondary blade 35, 36, 37, 38 (i.e., the sum of the backup face surface areas of all backup cutting faces 54 on each secondary blade 35, 36, 37, 38) is preferably greater than or equal to the total primary face surface area on each secondary blade 35, 36, 37, 38 (i.e., the sum of the primary face surface areas of all primary cutting face 44 on each secondary blade 35, 36, 37, 38). In particular, the ratio of the total backup face surface area on each secondary blade 35, 36, 37, 38 to the total primary face surface area on each secondary blade 35, 36, 37, 38 is preferably greater than or equal to 1.0, more preferably greater than or equal to 1.2, and even more preferably greater than or equal to 1.5. In this embodiment, each secondary blade 35, 36, 37, 38 has eight backup cutter elements 50 and seven primary cutter elements 40. Since each cutting face 44, 54 has substantially the same geometry, the total backup face surface area on each secondary blade 35, 36, 37, 38 is greater than the total primary face surface area on each secondary blade 35, 36, 37, 38. For an exemplary bit 10 having cutting faces 44, 54 with a ~16 mm (0.625 in.) diameter, each cutting face 44, 54 has a face surface area of about 200 $mm^2$ (~0.31 $in.^2$) (where face surface area=$\pi$*(16 mm/2)$^2$. Thus, for such an exemplary bit 10, the total backup face surface area on each secondary blade 35, 36, 37, 38 is about 1600 $mm^2$ (eight backup cutting faces 54 on each secondary blade 35, 36, 37, 38 multiplied by 200 $mm^2$ per backup cutting face 54), and the total primary face surface area on each secondary blade 35, 36, 37, 38 is about 1400 $mm^2$ (seven primary cutting faces 44 on each secondary blade 35, 36, 37, 38 multiplied by 200 $mm^2$ per primary cutting face 44). Thus, in this embodiment, the ratio of the total backup face surface area on each secondary blade 35, 36, 37, 38 to the total primary face surface area on each secondary blade 35, 36, 37, 38 is about 1.14.

As compared to some conventional fixed cutter bits, inclusion of backup rows 55 of backup cutter elements 50 on each primary blade 31, 32, 33, 34, and first and second backup rows 55, 56 of backup cutter elements 50 on each secondary blade 35, 36, 37, 38 offer the potential for increased total backup face surface area, increased total face surface area, and increased diamond volume in embodiments where cutting faces 44, 54 comprise PCD or PCD compacts. Backup rows 55, 56 of backup cutter elements 50 offer the potential for enhanced ROP and improved durability. In particular, the cutting path of backup cutter elements 50 at least partially overlaps with the cutting path of primary cutter elements 40 on the same blade. Since backup cutter elements 50 trail primary cutter elements 40 on the same blade, they generally engage the formation to a lesser degree than the primary cutter elements 40. However, in the event that a primary cutter element 40 wears or becomes damaged, one or more backup cutter elements 50 trailing the worn or damaged primary cutter element 40 may take over the cutting duty of the worn or damaged primary cutter element 40, enabling continued drilling with bit 10.

Without being limited by this or any particular theory, the cutter elements of a fixed cutter bit positioned in the shoulder region of the bit tend to bear a majority of the weight on bit, and thus, tend to perform the bulk of the formation cutting and removal. Consequently, such cutter elements typically have the greatest impact on the overall ROP of the bit. Therefore, it is preferred that at least some of backup cutter elements 50 provided on bit 10 are positioned in shoulder region 25. In the embodiment shown in FIG. 4, each backup cutter elements 50 on each primary blade 31, 32, 33, 34, and each secondary blade 35, 36, 37, 38 is at least partially positioned in shoulder region 25. Consequently, embodiments of bit 10 offer the potential for an increased total number of cutter elements 40, 50 in shoulder region 25, an increased total cutting face surface area in shoulder region 25, and an increased diamond volume in shoulder region 25. Thus, embodiments of bit 10 offer the potential for increased formation removal and ROP as compared to a similar bit without any, or with fewer, backup cutter elements shoulder region.

It should be appreciated that due to the additional circumferential space required on a blade (e.g., primary blade, secondary blade, etc.) to mount backup cutter elements (e.g., backup cutter elements 50), a blade with backup cutter elements tends to be wider as compared to a similar blade without backup cutter elements. In other words, backup cutter elements often necessitate the need for a wider blade providing sufficient cutter-supporting surface area to accommodate both primary and backup cutter elements. In the embodiments described herein, the majority of backup cutter elements 50 are disposed on secondary blades 35, 36, 37, 38. In particular, secondary blades 35, 36, 37, 38 each include a second backup row 56 of backup cutter elements 50. Inclusion of second backup row 56 on each secondary blade 35, 36, 37, 38, as compared to adding a second backup row to each primary blade 31, 32, 33, 34, offers the potential for improve bit hydraulics. More specifically, it is typically preferred to have a nozzle disposed along the leading side of each blade (i.e., each primary blade, secondary blade, etc.) generally proximal the radially inner end of each primary blade and each secondary blade. Such placement allows drilling fluid to flow out the nozzle, radially outward across the cutter elements of each blade as the bit rotates, and axially upward toward the annulus between the drill string and the borehole sidewall to the surface. For instance, as best shown in FIG. 4, one nozzle 22 is positioned along the leading edge of each primary blade 31, 32, 33, 34 and each secondary blade 35, 36, 37, 38 proximal its radially inner end. Widening of each primary blade to accommodate a second trailing backup row of backup cutter elements may detrimentally reduce the circumferential space along the leading edge of the immediately trailing secondary blade, thereby inhibiting the placement and size of a nozzle along the leading edge of the immediately trailing secondary blade. For example, the radially inner ends of primary blades 31, 32, 33, 34 are disposed within the cone region 24, and thus, widening of secondary blades 35, 36, 37. 38, which begin at the transition between the cone region 24 and the shoulder region 25, has little to no effect on nozzles 22 within cone region 24 along the leading edge of each primary blade 31, 32, 33, 34. However, widening of primary blades 31, 32, 33, 34, each of which extends from cone region 24 to gage region 26, impacts the circumferential space available for nozzles 22 in shoulder region 25 along the leading edge of secondary blades 35, 36, 37, 38. Consequently, to maintain sufficient bit hydraulics, it is preferred that additional backup rows (e.g., second backup rows 56) are disposed on the secondary blades, rather than on the primary blades. Moreover, since secondary blades 35, 36, 37, 38 are disposed in the shoulder region 25, backup cutter elements 50 mounted to secondary blades 35, 36, 37, 38 may be advantageously disposed in shoulder region 25 where a bulk of cutting is performed.

As one skilled in the art will appreciate, numerous variations in the size, orientation, and locations of primary cutter elements 40 and backup cutter elements 50 along one or more primary and/or secondary blades is possible. Certain features and variations of primary cutter elements 40 and backup cutter elements 50 of bit 10 may be best understood with reference to schematic enlarged top views, rotated profile views, and cross-sectional views of exemplary primary blade 31 and exemplary secondary blade 35 described in more detail below.

Figure 5A:
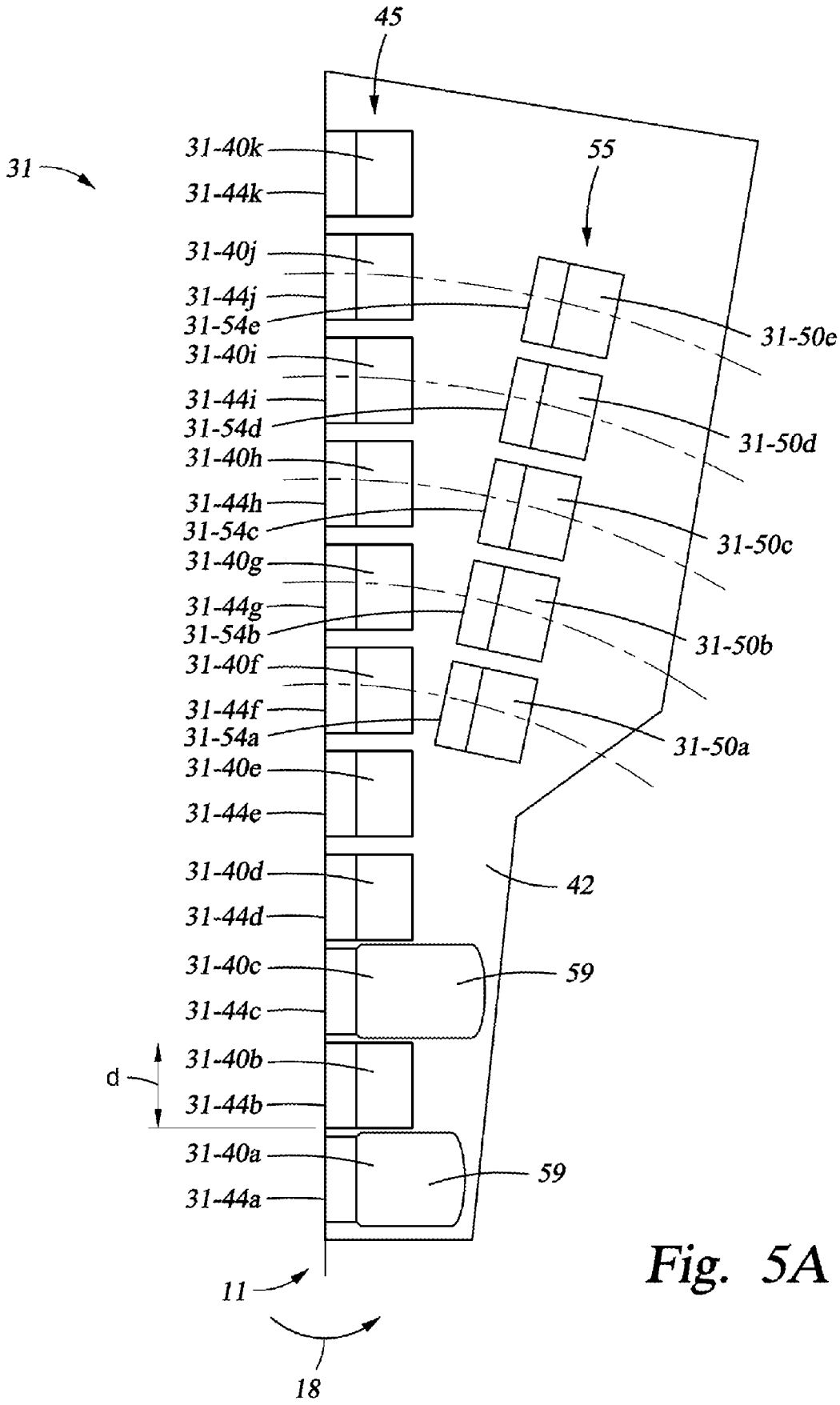
FIG. 5A is a schematic top view of one of the primary blades shown in FIG. 1.
Figure 5B:
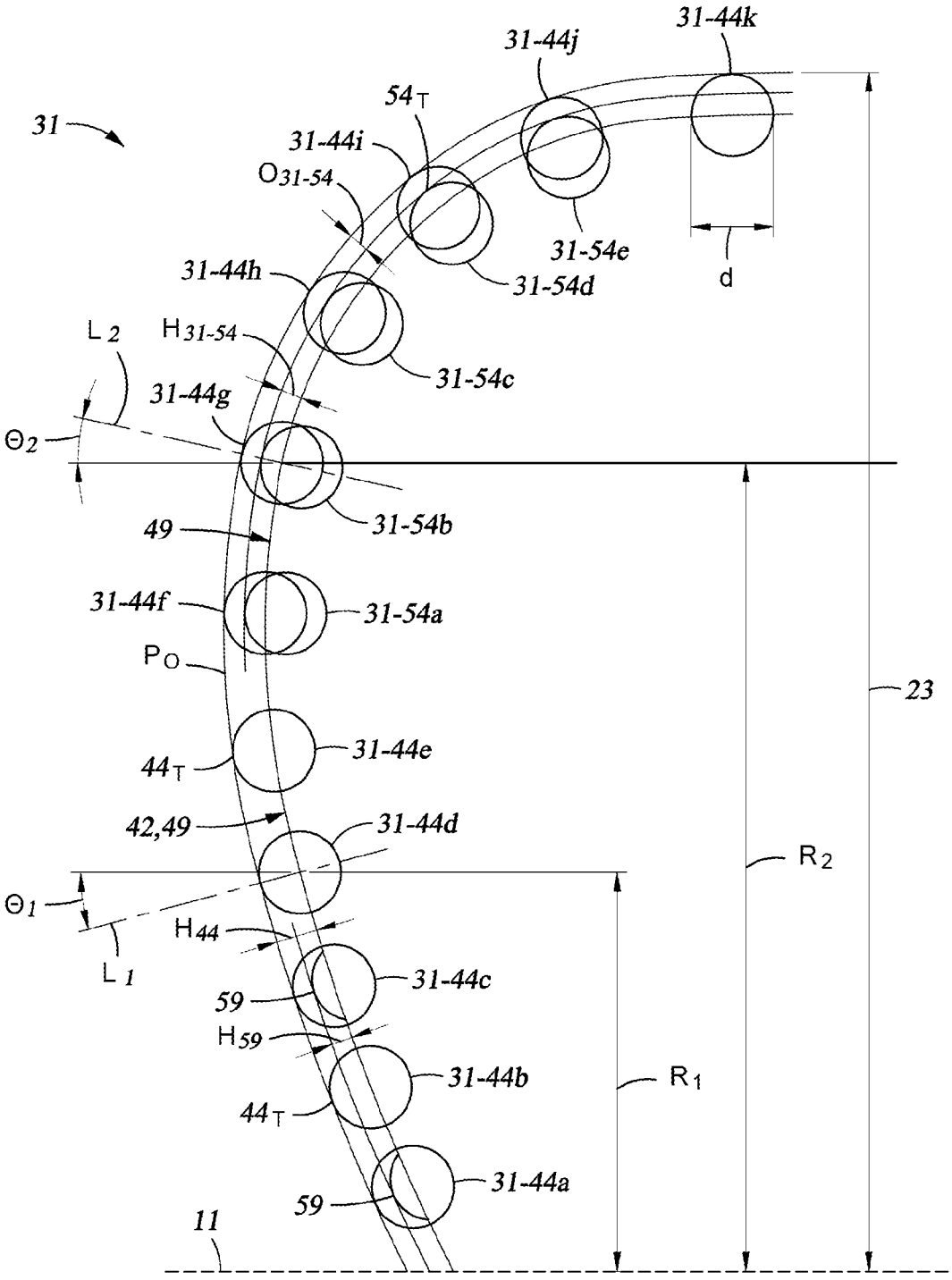
FIG. 5B is a schematic view showing the rotated profile of the primary blade shown in FIG. 5A.

FIG. 5A is an enlarged schematic top view of primary blade 31 and its associated primary cutter elements 40 and backup cutter elements 50. FIG. 5B schematically illustrates primary blade 31 and each cutter element 40, 50 mounted thereon rotated into a single rotated profile view.

Referring now to FIG. 5A, for purposes of clarity and further explanation, primary cutter elements 40 mounted to primary blade 31 are assigned reference numerals 31-40*a-k*, there being eleven primary cutter elements 40 mounted to cutter-supporting surface 42 of primary blade 31. Likewise, backup cutter elements 50 mounted to primary blade 31 are assigned reference numerals 31-50*a-e*, there being five backup cutter elements 50 mounted to cutter-supporting surface 42 of primary blade 31. Primary cutting faces 44 of primary cutter elements 31-40*a-k* are assigned reference numerals 31-44*a-k*, respectively, and backup cutting faces 54 of backup cutter elements 31-50*a-e* are assigned reference numerals 31-54*a-e*, respectively.

Row 55 of backup cutter elements 31-50*a-e* is positioned behind, and trails, row 45 of primary cutter elements 31-40*a-k* provided on the same primary blade 31. In addition, as will be explained in more detail below, each backup cutter element 31-50*a-e* is disposed at the same radial position as an associated primary cutter element 31-40*f-j*, respectively. In other embodiments, one or more backup cutter elements may not be disposed at the same radial position as an associated primary cutter element on the same blade.

Referring still to FIG. 5A, in this embodiment, primary cutter elements 31-40*a-k* and backup cutter elements 31-50*a-e* each have substantially the same cylindrical geometry and size. In particular, each primary cutting face 31-44*a-k* and each backup cutting face 31-54*a-e* has substantially the same diameter d. For an exemplary bit 10 having an overall gage diameter of 12.25 in. (~31.1 cm), diameter d of each cutting face 31-44*a-k* and 31-54*a-e* is about 16 mm (~0.625 in.). In other embodiments, the geometry of one or more primary cutting face and/or one or more backup cutting face may be different. For instance, in other embodiments, the backup cutter elements have a smaller diameter than the primary cutter elements on the same blade.

Referring now to FIG. 5B, the profiles of primary blade 31 and cutting faces 31-44*a-k* and 31-54*a-e* are shown rotated into a single rotated profile. In rotated profile view, primary blade 31 forms a blade profile 49 generally defined by the cutter-supporting surface 42 of primary blade 31. Blade profile 49 is coincident with composite blade profile 39 previously described with reference to FIG. 3. Primary cutting faces 31-44*a-k* in primary row 45 each have substantially the same extension height $H_{44}$ measured perpendicularly from cutter-supporting surface 42 of primary blade 31 to the outermost cutting tip $\mathbf{44}_T$ of each cutting face 31-44*a-k*. Thus, as used herein, the phrase "extension height" may be used to refer to the distance or height to which a structure (e.g., cutting face, depth-of-cut limiter, etc.) extends perpendicularly from the cutter-supporting surface of the blade to which it is mounted. Although each primary cutting face 31-44*a-k* has generally the same extension height $H_{44}$ in this embodiment, in other embodiments, the extension height of one or more primary cutting faces on a given blade may vary.

Likewise, each backup cutting face 31-54*a-e* in backup row 55 has substantially the same extension height $H_{54}$. In other embodiments, the extension height of one or more backup cutting faces on a given blade may vary. Further, in this embodiment, extension height $H_{54}$ of each backup cutting face 31-54*a-e* is less than extension height $H_{44}$ of each primary cutting face 31-44*a-k*. Thus, primary cutting faces 31-44*a-k* will tend to engage the formation before backup cutting faces 31-54*a-e*, and further, tend to engage a greater depth of formation as compared to backup cutting faces 31-54*a-e*.

Referring still to FIG. 5B, each depth-of-cut limiter 59 has substantially the same extension height $H_{59}$. In this embodiment, extension height $H_{59}$ of depth-of-cut limiters 59 is less than extension height $H_{44}$ of each primary cutting face 31-44*a-k* and less than extension height $H_{54}$ of each backup cutting face 31-54*a-e*. Thus, primary cutting faces 31-44*a-k* and backup cutting faces 31-54*a-e* will tend to engage the formation before depth-of-cut limiters 59.

The outermost or distal cutting tips of primary cutting faces 31-44*a-k* disposed at extension height $H_{44}$ define an outermost cutting profile $P_o$ that extends radially from bit axis 11 to outer radius 23. In general, the outermost cutting profile (e.g., outermost cutting profile $P_o$) is defined by a curve passing through each cutting tip (e.g., cutting tip $\mathbf{44}_T$, $\mathbf{54}_T$) that is not eclipsed or covered by another cutting face (e.g., cutting face 44, 54) in rotated profile view. Thus, as used herein, the phrase "outermost cutting profile" refers to the curve or profile passing through each cutting tip that is not eclipsed or covered by the cutting face of another cutter element in rotated profile view. The outermost cutting profile does not pass through the cutting tips that are eclipsed or covered by another cutting face in rotated profile view. As shown in FIG. 5B, none of cutting tips $\mathbf{44}_T$ of primary cutting faces 31-44*a-k* is eclipsed or covered by another cutting face 44, 54 in rotated profile view, however, cutting tip $\mathbf{54}_T$ of each backup cutting face 31-54*a-e* is covered or eclipsed by a primary cutting face 44 in rotated profile view. Thus, outermost cutting profile $P_o$ passes through the cutting tip $\mathbf{44}_T$ of each primary cutting face 31-44*a-k*, but does not pass through the cutting tip $\mathbf{54}_T$ of any backup cutting face 31-54*a-e*.

Since backup cutting faces 31-54*a-e* do not extend to cutting profile $P_o$, backup cutting faces 31-54*a-e* may also be described as being "off profile" relative to outermost cutting profile $P_o$. As used herein, the phrase "off profile" refers to a structure (e.g., cutter element) extending from the cutter-supporting surface of a blade (e.g., cutter supporting surface 42, 52) that does not extend to the outermost cutting profile (e.g., outermost cutting profile $P_o$) in rotated profile view, whereas, the phrase "on profile" refers to structure that extends from the cutter-supporting surface to the outermost cutting profile in rotated profile view. The degree to which an off-profile structure is offset from the outermost cutting profile may be described in terms of a "cutting profile offset distance" equal to the minimum or shortest distance between the structure and the outermost cutting profile in rotated profile view. In the embodiment shown in FIG. 5B, each backup cutting faces 31-54*a-e* is offset from the outermost cutting profile $P_o$ by a cutting profile offset distance $O_{54}$ equal to difference between extension height $H_{44}$ and extension height $H_{54}$. Offset distance $O_{54}$ is preferably less than 0.100 in. (~2.54 mm), and more preferably between 0.040 in. (~1.02 mm) and 0.060 in. (~1.52 mm). Although backup cutting faces 31-54*a-e* are off-profile in this embodiment, in other embodiments, one or more of the backup cutting faces (e.g., backup cutting faces 31-54*a-e*) may be on-profile.

The amount or degree of offset of backup cutting faces 31-54*a-e* relative to outermost cutting profile $P_o$ may also be expressed in terms of an offset ratio. As used herein, the phrase "offset ratio" refers to the ratio of the distance a cutting face is offset from the outermost cutting profile to the diameter d of the cutting face(s) defining the outermost cutting profile. For example, the offset ratio for backup cutting faces 31-54*a-e* is the ratio of offset $O_{54}$ to diameter d. The offset ratio is preferably between 0.020 and 0.200. In this exemplary embodiment, the offset ratio of backup cutting faces 31-54*a-e* relative to outermost cutting profile $P_o$ defined by primary cutting faces 31-44*a-k* is about 0.064.

As previously described, in this embodiment, each primary cutting face 44 is shown as having the same extension height $H_{44}$, and each backup cutting face 54 is shown as having the same extension height $H_{54}$ that is less than the extension height $H_{44}$ of each primary cutting face 44. However, in other embodiments, the extension heights of one or more primary cutting faces and/or one or more backup cutting face may vary. Further, in some embodiments, the backup cutting faces (e.g., backup cutting faces 31-54*a-e*) may have the same extension height as the primary cutting faces (e.g., primary cutting faces 31-44*a-k*), resulting in an offset distance of zero. In such an arrangement, the backup cutting faces may be described as being "on profile" relative to the primary cutting faces on the same blade. In still other embodiments, one or more backup cutting face may have a greater extension height than one or more primary cutting face on the same blade.

Referring still to the rotated profile view of FIG. 5B, each backup cutting face 31-54*a-e* is disposed on cutter-supporting surface 42 of primary blade 31 at the same radial position (relative to bit axis 11) as a corresponding primary cutting face 31-44*f-j*, respectively, on the same blade 31. Thus, each backup cutting face 31-54*a-e* is redundant to and tracks an associated primary cutting face 31-44*f-j*, respectively, on the same blade 31. As used herein, the term "redundant" may be used to describe a cutter element that is disposed at the same radial position as one or more other cutter element(s) on the same blade or on different blade(s). The description of two or more structures, such as two cutter elements, as being "redundant" or as being at the "same radial position" relative to the bit axis (e.g., bit axis 11) means that the structures are intended and designed to be at the exact same radial position relative to the bit axis. Although such structures are intended to be at the exact same radial position relative to the bit axis, due to manufacturing limitations and associated tolerances, the actual manufactured radial position of such two or more structures may not be identical. Accordingly, as used herein, the phrase "redundant" or "same radial position" is used to describe both of the following: (a) structures that are at the exact same radial position relative to the bit axis, and (b) structures that are, within manufacturing tolerances, disposed at the same actual radial position relative to the bit axis. For most bits, the manufacturing tolerance for the radial position of any given cutter element typically ranges from about +/−0.005 in. (~0.127 mm) to +/−0.030 in. (~0.762 mm). Alternatively, cutter elements that are not disposed at the same radial position as any other cutter element on the bit may be described as being at a "unique" radial position.

Referring still to FIG. 5B and for purposes of this disclosure, the radial position of a given cutter element is generally defined by the radial distance from the bit axis to the point on the cutter supporting surface at which the cutter element is mounted. Specifically, the cutting face of each cutter element may be described as being bisected by a "profile angle line" that is perpendicular to the outermost cutting profile $P_o$ in rotated profile view. Thus, as used herein, the phrase "profile angle line" may be used to refer to a line perpendicular outermost cutting profile in rotated profile view, and that bisects a cutting face in rotated profile view. For example, a profile angle line $L_1$ bisects primary cutting face 31-44*d* of primary cutter element 31-40*d* in rotated profile view. Each profile angle line is oriented at a profile angle θ measured between the bit axis (or a line parallel to the bit axis) and the profile angle line in rotated profile view. Thus, as used herein, the phrase "profile angle" may be used to refer to the angle between a profile angle line and a line parallel to the bit axis in rotated profile view. For example, profile angle line $L_1$ of primary cutting face 31-44*d* is oriented at a profile angle $\theta_1$. The radial position of a given cutter element is the radial distance measured perpendicularly from the bit axis to the intersection of the cutter-supporting surface or blade profile of the blade to which the cutter element is mounted and the profile angle line that is perpendicular to outermost cutting profile and that bisects the cutting face in rotated profile view. For example, as shown in FIG. 5B, the radial position of primary cutting face 31-44*d* is defined by a radial distance $R_1$ measured perpendicularly from bit axis 11 to the point of intersection of blade profile 49 and profile angle line $L_1$. As another example, the radial position of primary cutting face 31-44*g* is defined by a radial distance $R_2$ measured perpendicularly from bit axis 11 to the point of intersection of blade profile 49 and profile angle line $L_2$. Profile angle line $L_2$ is perpendicular to outermost cutting profile $P_o$ and bisects primary cutting face 31-44*g*. Further, profile angle line $L_2$ forms a profile angle $\theta_2$ measured between bit axis 11 (or a line parallel to bit axis 11) and profile angle line $L_2$.

It should be appreciated that cutter elements disposed at the same radial position share a common profile angle line and have the same profile angle in rotated profile view, whereas cutter elements at different radial positions do not share a profile angle line and have different profile angles in rotated profile view. Thus, for example, redundant cutter elements 31-40*f*, 31-50*a* share a common profile angle line and have the same profile angle.

During rotation of the bit, redundant cutter elements follow in the same path. The leading redundant cutter element tends to clear away formation material, allowing the trailing redundant element to follow in the path at least partially cleared by the preceding cutter element. As a result, during rotation the redundant cutter elements tend to be subjected to less resistance from the earthen material and less wear than the preceding element. The decrease in resistance reduces the stresses placed on the redundant cutter elements and may improve the durability of the element by reducing the likelihood of mechanical failures such as fatigue cracking.

It is to be understood that cutter elements arranged in a radially extending row are disposed at different radial positions. Thus, each primary cutter element 31-40*a-k* in primary row 45 on primary blade 31 has a different radial position, and each backup cutter element 31-40*a-e* in backup row 55 has a different radial position.

Referring still to FIG. 5B, as a result of the relative sizes and radial positions of primary cutting faces 31-44*a-k* and backup cutting faces 31-54*a-e*, the cutting profile or path of each backup cutting face 31-54*a-e* is substantially eclipsed or overlapped by the cutting profile or path of its associated primary cutting face 31-44*f-j*, respectively. More specifically, in this embodiment the profile of each backup cutting face 31-54*a-e* is completely eclipsed by the profile of its associated primary cutting face 31-44*f-j*, respectively. In other embodiments, the cutting profile of one or more backup cutting face may be partially eclipsed or not eclipsed at all by the cutting profile of a primary cutting face on the same blade.

Although exemplary primary blade 31 is shown and described in FIGS. 5A and 5B, remaining primary blades 32, 33, 34 are similarly configured. Namely, in this embodiment, each primary cutting face 44 on each primary blade 31-34 has the same extension height $H_{44}$, and further, each primary cutting face 44 on each primary blade 31-34 extends to outermost cutting profile $P_o$ in rotated profile view. In addition, each backup cutter element 50 in each backup row 55 on each primary blade 31-34 is disposed at the same radial position as an associated primary cutter element 40 on the same primary blade 31-34. However, in an effort to maximize bottomhole coverage, primary cutter elements 40 on primary blades 31-34 are staggered relative to each other and disposed at a different radial positions.

Figure 6A:
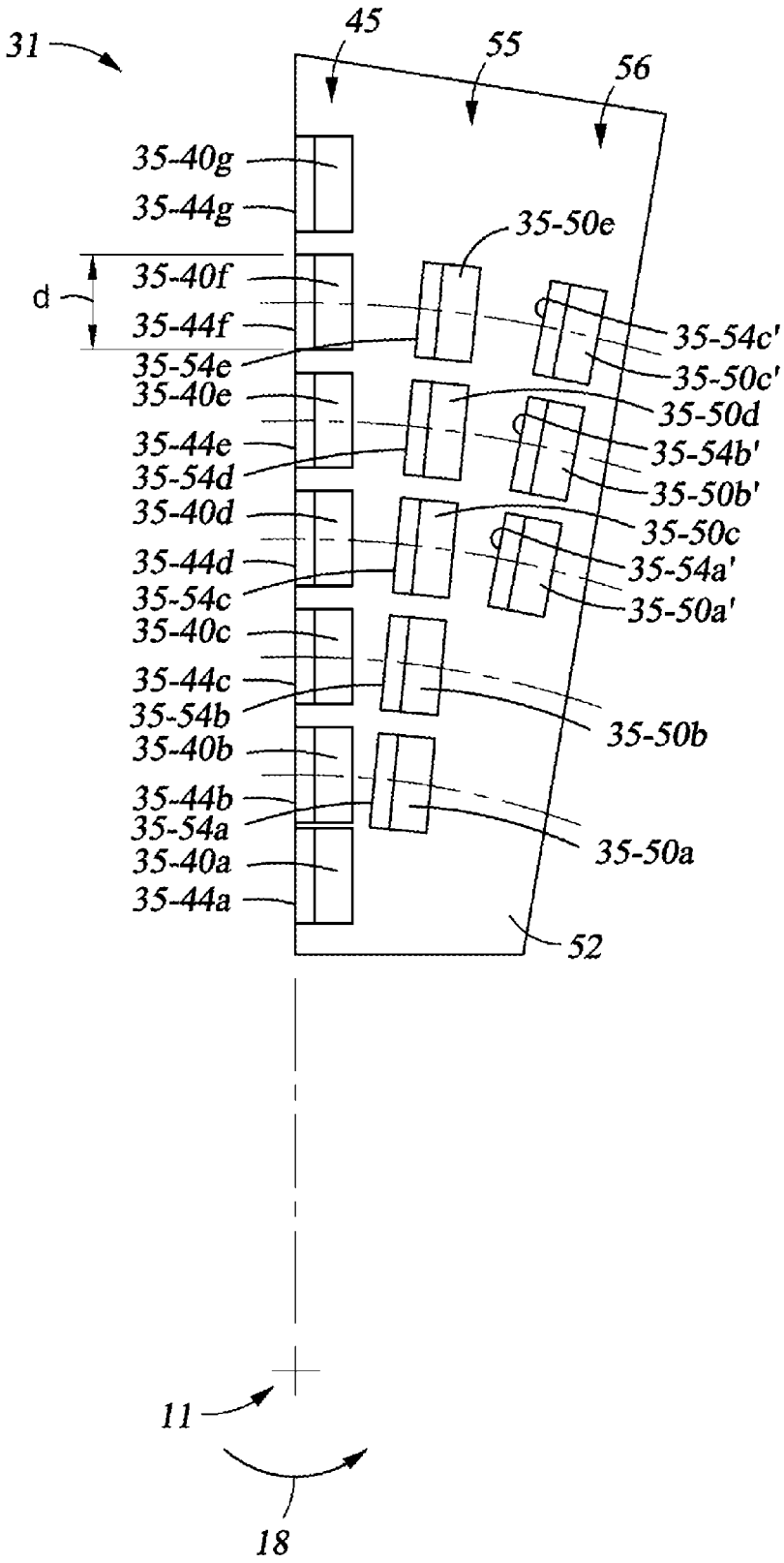
FIG. 6A is a schematic top view of one of the secondary blades shown in FIG. 1.
Figure 6B:
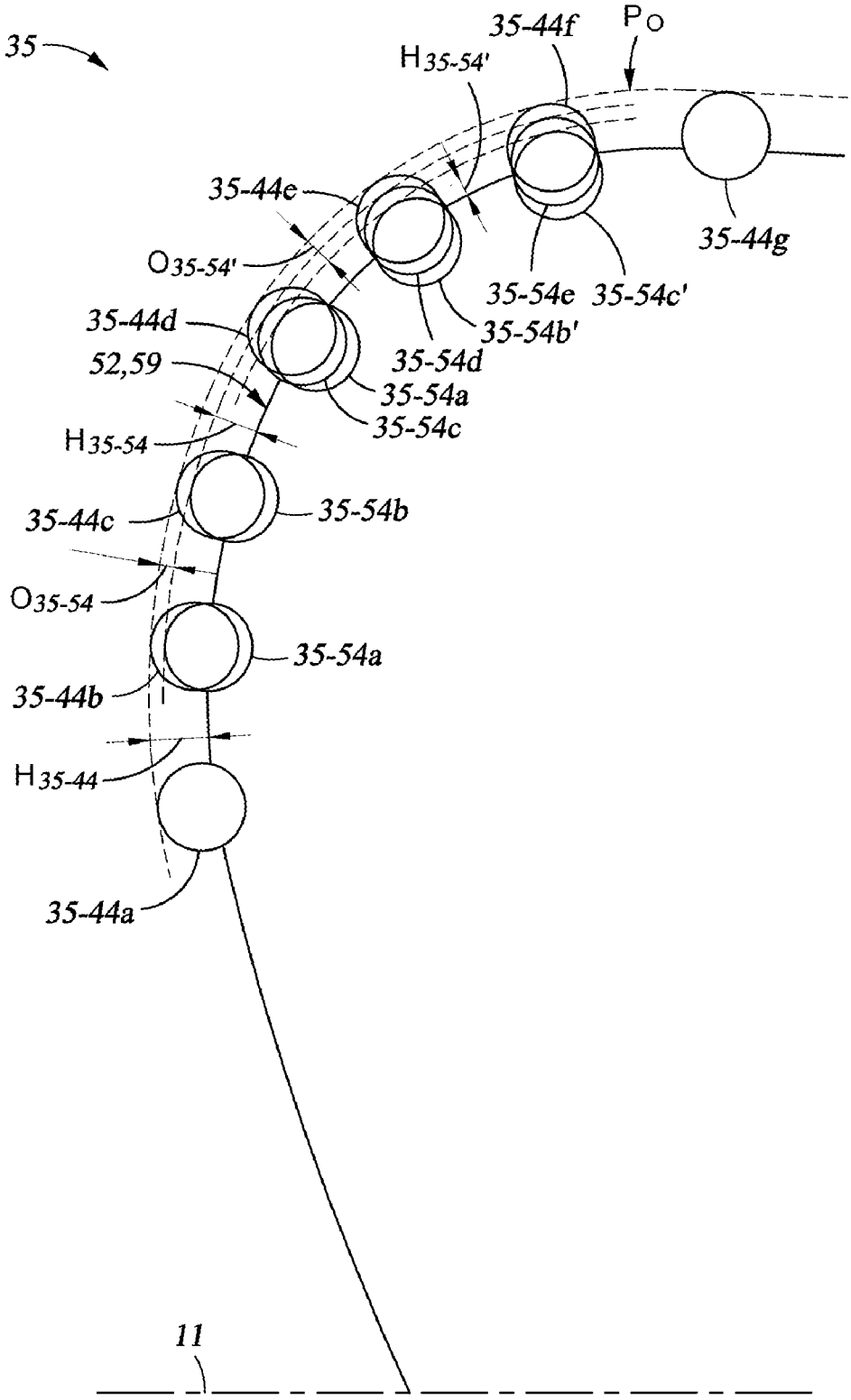
FIG. 6B is a schematic view showing the rotated profile of the secondary blade shown in FIG. 6A.

FIG. 6A is an enlarged schematic top view of secondary blade 35 and its associated primary cutter elements 40 and backup cutter elements 50. FIG. 6B schematically illustrates secondary blade 35 and each of its associated primary cutter elements 40 and backup cutter elements 50 rotated into a single rotated profile view.

Referring now to FIG. 6A, for purposes of clarity and further explanation, primary cutter elements 40 mounted to secondary blade 35 in primary row 45 are assigned reference numerals 35-40*a-g*, there being seven primary cutter elements 40 mounted to cutter-supporting surface 52 of secondary blade 35. Likewise, backup cutter elements 50 mounted to secondary blade 35 in first backup row 55 are assigned reference numerals 35-50*a-e*, there being five backup cutter elements 50 in first backup row 55 on secondary blade 35. Still further, backup cutter elements 50 mounted to secondary blade 35 in second backup row 56 are assigned reference numerals 35-50*a'-c'*, there being three backup cutter elements in second backup row 56 on secondary blade 35. Primary cutting faces 44 of primary cutter elements 35-40*a-g* are assigned reference numerals 35-44*a-g*, respectively, backup cutting faces 54 of backup cutter elements 35-50*a-e* are assigned reference numerals 35-54*a-e*, respectively, and backup cutting faces 54 of backup cutter elements 35-50*a'-c'* are assigned reference numerals 35-54*a'-c'*, respectively.

First backup row 55 of backup cutter elements 35-50*a-e* is positioned behind, and trails, row 45 of primary cutter elements 35-40*a-g* provided on the same secondary blade 35. Further, second backup row 56 of backup cutter elements 35-50*a'-c'* is positioned behind, and trails, first backup row 55 of backup cutter elements 35-50*a-e*. Each backup cutter element 35-50*a-e* in first backup row 55 is disposed at the same radial position as an associated primary cutter element 35-40*b-f*, respectively, and each backup cutter element 35-50*a'-c'* in second backup row 56 is disposed at the same radial position as an associated backup cutter element 35-50*c-e*, respectively, in first backup row 55. Thus, each backup cutter element 35-50*a'-c'* in second backup row 56 is disposed at the same radial position as an associated primary cutter element 35-40*d-f*, respectively. In other embodiments, one or more backup cutter elements may not be disposed at the same radial position as an associated primary cutter element on the same blade.

In this embodiment, primary cutter elements 35-50*a-g*, backup cutter elements 35-50*a-e*, and backup cutter elements 35-50*a'-c'* on secondary blade 35 each have the same cylindrical geometry and size as cutter elements 40, 50 on primary blade 31 previously described. Consequently, each primary cutting face 35-44*a-g*, each backup cutting face 35-54*a-e*, and each backup cutting face 35-54*a'-c'* has substantially the same diameter d. In other embodiments, the geometry of one or more primary cutting face and/or one or more backup cutting face may be different. In a particular embodiment, backup cutter elements in the first backup row (e.g., backup cutter elements 35-50*a-e* in first backup row 55) may have smaller diameters than the primary cutter elements in the primary row (e.g., primary cutter elements 35-40*a-g* in primary row 45), and backup cutter elements in the second backup row (e.g., backup cutter elements 35-50*a'-c'* in second backup row 56) may have smaller diameters than the backup cutter elements in the first backup row (e.g., backup cutter elements 35-50*a-e* in first backup row 55).

Referring now to FIG. 6B, the profiles of primary blade 35, cutting faces 35-44*a-g*, 35-54*a-e*, and 35-54*a'-c'* are shown rotated into a single rotated profile. In rotated profile view, secondary blade 35 forms a blade profile 59 generally defined by the cutter-supporting surface 52 of secondary blade 35. In this embodiment, blade profile 59 is coincident with the profiles of primary blades 31, 32, 33, 34 and secondary blades 35, 36, 37, 38, and thus, is coincident with composite blade profile 39 previously described.

Each primary cutting face 35-44*a-g* in primary row 45 extends to extension height H44 measured perpendicularly from cutter-supporting surface 52 of primary blade 35 to the outermost cutting tip 44T of each primary cutting face 35-44*a-g*. In addition, each backup cutting face 35-54*a-e* in first backup row 55 extends to extension height H54 measured perpendicularly from cutter-supporting surface 52 of primary blade 35 to the outermost cutting tip 54T of each backup cutting face 35-54*a-e*. As previously described, extension height H54 is less than extension height H44. Still further, each backup cutting face 35-54*a'-c'* in second backup row 56 has an extension height H54' measured perpendicularly from cutter-supporting surface 52 of primary blade 35 to the outermost cutting tip 54T of each backup cutting face 35-54*a'-c'*. In this embodiment, extension height H54' of each backup cutting face 35-54*a'-c'* is substantially the same. Further, in this embodiment, extension height H54' is less than extension height H54. Thus, primary cutting faces 35-44*a-g* will tend to engage the formation before backup cutting faces 35-54*a-e*, 35-54*a'-c'*, and backup cutting faces 35-54*a-e* will tend to engage the formation before backup cutting faces 35-54*a'-c'*.

As each primary cutting face 35-44*a-g* extends to extension height H44 previously described, each primary cutting face 35-44*a-g* extends to outermost cutting profile Po and may be described as being "on profile." In other embodiments, the primary cutting faces on one or more secondary blade (e.g., primary cutting face 35-44*a-g* on secondary blade 35) may be off-profile.

Backup cutting faces 35-54*a-e* in first backup row 55 are offset from cutting profile Po by offset distance O54. Offset distance O54 is preferably less than 0.100 in. (~2.54 mm), and more preferably between 0 and 0.060 in. (~1.524 mm). In addition, backup cutting faces 35-54*a'-c'* in second backup row 56 are offset from cutting profile Po by an offset distance O54'. Offset distance O54' is preferably less than 0.100 in. (~2.54 mm), and more preferably between 0 in. and 0.080 in. (~2.032 mm). In some embodiments, offset distance O54' is a function of offset distance O54. For example, offset distance O54' may be equal to 1.5*(offset distance O54). The offset ratio for backup cutting faces 35-54*a-e* is preferably between 0.020 and 0.200, and the offset ratio for backup cutting faces 35-54*a'-c'* is preferably between 0.020 and 0.200.

In this embodiment, the row of primary cutter elements 40 on secondary blade 35 are staggered (i.e., are disposed at different radial positions) relative to the primary cutter elements 40 on primary blades 31, 32, 33, 34. In addition, the row of primary cutter elements 40 on secondary blade 35 are staggered relative to primary cutter elements 40 on the other secondary blades 36, 37, 38, thereby offering the potential to enhance the bottomhole coverage of bit 10, and reduce the formation of uncut ridges between adjacent cutter elements in rotated profile.

Referring still to FIG. 6B, as a result of the relative sizes and radial positions of primary cutting faces 35-44*a-g* and backup cutting faces 35-54*a-e*, the cutting profile or path of each backup cutting face 35-54*a-e* is substantially eclipsed or overlapped by the cutting profile or path of its associated primary cutting face 35-44*b-f*, respectively. Further, as a result of the relative sizes and radial positions of backup cutting faces 35-54*a-e*, backup cutting faces 35-54*a'-c'*, the cutting profile or path of each backup cutting face 35-54*a'-c'* is substantially eclipsed or overlapped by the cutting profile or path of its associated backup cutting face 35-54*c-e*, respectively.

Although secondary blade 35 is shown and described in FIGS. 6A and 6B, remaining secondary blades 36-38 are similarly configured. Namely, each primary cutting face 44 on each secondary blade 35-38 extends to outermost cutting profile Po, each backup cutting face 54 in the first backup row 55 is off-profile, and each backup cutting face 54 in second backup row 56 is off-profile. Further, the offset of backup cutting faces 54 in each second backup row 56 is greater than the offset of each backup cutting face 54 in each first backup row 55. In addition, backup cutter elements 50 in each first backup row 55 on each secondary blade 35-38 are disposed at the same radial position as an associated primary cutter element 40 on the same secondary blade 35-38. And further, backup cutter elements 50 in each second backup row 56 on each secondary blade 35-38 are disposed at the same radial position as an associated backup cutter element 50 in first backup row 55 on the same secondary blade 35-38. However, in an effort to maximize bottomhole coverage, primary cutter elements 40 on different secondary blades 35-38 are preferably staggered relative to each other and disposed at different radial positions.

Figure 6C:
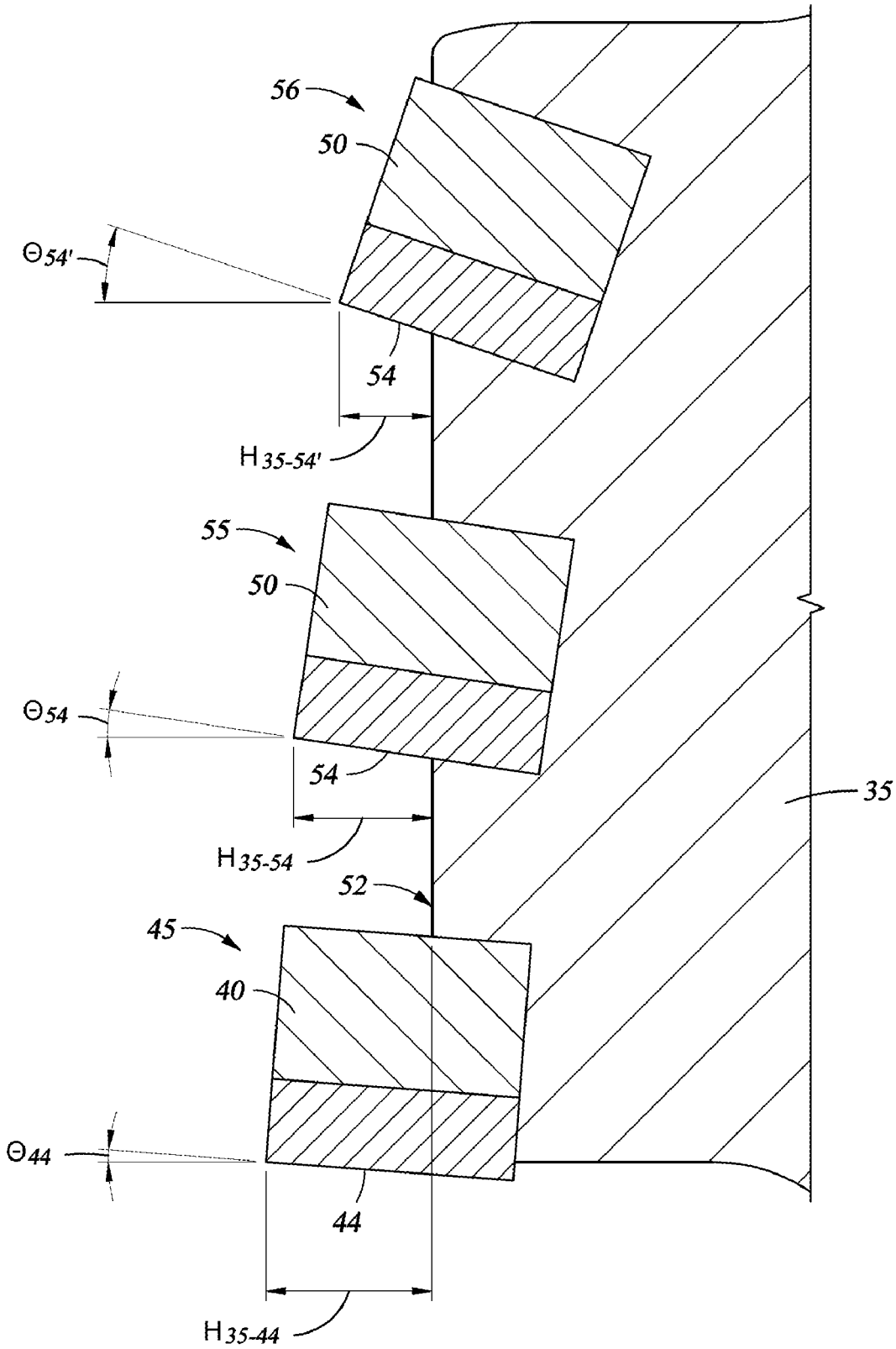
FIG. 6C is a schematic cross-sectional view of one of the secondary blades shown in FIG. 1.

Referring now to FIG. 6C, a schematic cross-sectional view of secondary blade 35, one primary cutter element 40 in primary row 45, one backup cutter element 50 in first backup row 55, and one backup cutter element 50 in second backup row 56 is shown. Cutter elements 40, 50 shown in FIG. 6C are each disposed at the same radial position, such as primary cutter element 35-40*d*, backup cutter element 35-50*c*, and backup cutter element 35-50*a'*.

As previously described, each primary cutting faces 44 in primary row 45 extend to an extension height H35-44, each backup cutting face 54 in first backup row 55 extends to an extension height H35-54, and each backup cutting face 54 in second backup row 56 extends to an extension height H35-54'. In this embodiment, cutting faces 44, 54 are oriented with a backrake angle. In particular, the forward facing surface of primary cutting face 44 in primary row 45 is oriented at a backrake angle θ44, forward facing surface of backup cutting face 54 in first backup row 55 is oriented at a backrake angle θ54, and forward facing surface of backup cutting face 54 in second backup row 56 is oriented at a backrake angle θ54'. In conventional manner, backrake angles θ44, θ54, θ54" are measured relative to the surface vector defining blade surface 52.

Referring still to FIG. 6C, backrake angle θ44 is preferably between 5° and 30°, backrake angle θ54 is preferably between 10° and 30°, and backrake angle θ54' is preferably between 15° and 30°. Further, backrake angle θ44 is preferably less than backrake angle θ54, and backrake angle θ54 is preferably less than backrake angle θ54'. In this particular embodiment, backrake angle θ44 is about 10°, backrake angle θ54 is about 15°, and backrake angle θ54' is about 18°. In other embodiments, backrake angle θ44 may be between 15° and 30°, backrake angle θ54 may be between 10° and 30°, and backrake angle θ54' may be between 15° and 30°, with backrake angle θ44 being greater than backrake angle θ54, and backrake angle θ54 being greater than backrake angle θ54'.

Figure 7:
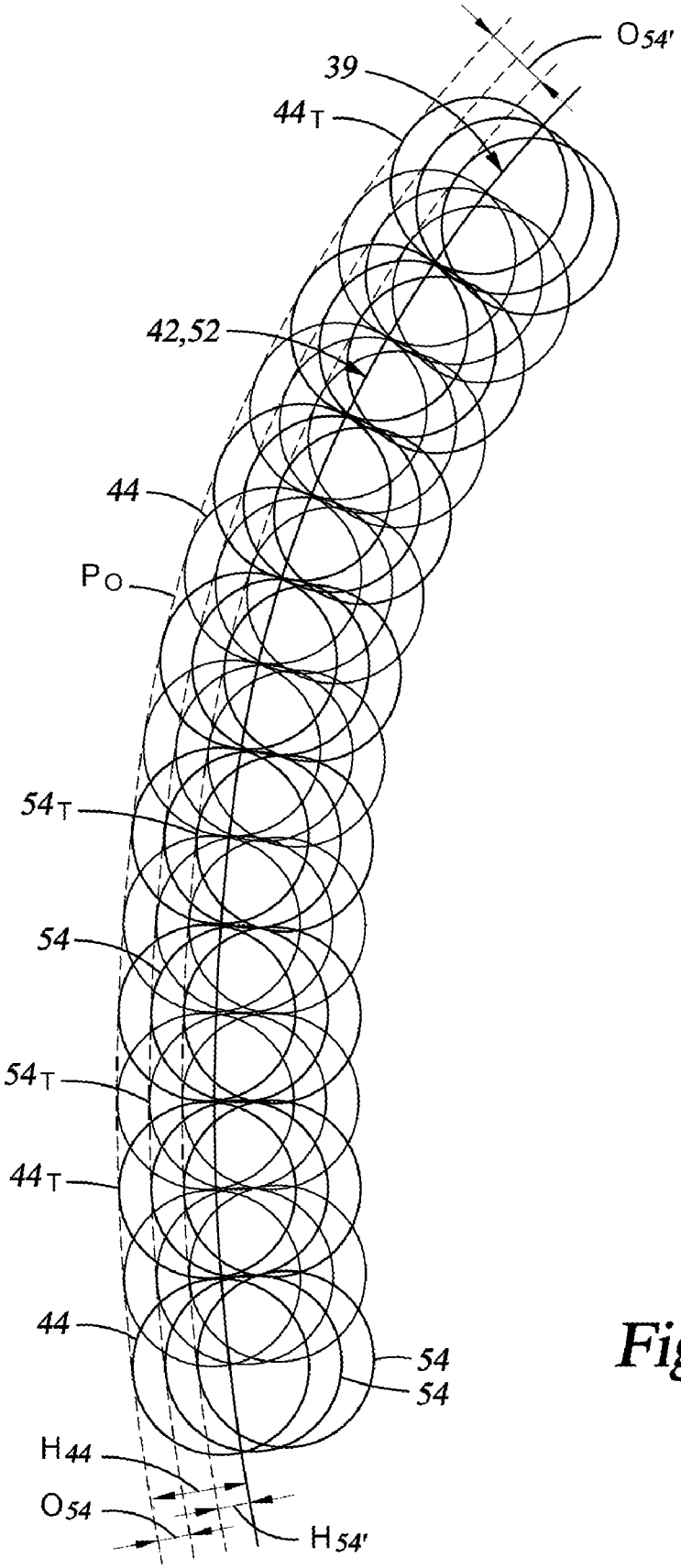
FIG. 7 is a partial composite rotated profile view of the bit shown in FIG. 1.

Referring now to FIG. 7, the profiles of primary blades 31-34, secondary blades 35-38, and cutting faces 44, 54 are schematically shown rotated into a single composite rotated profile view. For purposes of clarity, only a partial view of the single composite rotated profile is shown. In rotated profile view, each primary blade 31-34 and each secondary blade 35-38 extends along blade profile 39 previously described.

In this embodiment, each primary cutting face 44 extends to substantially the same extension height H44 measured perpendicularly from cutter-supporting surface 42, 52 (or blade profile 39) to its outermost cutting tip 44T. None of cutting tips 44T is eclipsed or covered by another cutting face 44, 54, and thus, each cutting tip 44T lies on outermost cutting profile Po and is "on-profile." In this embodiment, outermost cutting profile Po is generally parallel to blade profile 39. In addition, each backup cutting face 54 in each first backup row 55 extends to substantially the same extension height H54 measured perpendicularly from cutter-supporting surface 42, 52 to its outermost cutting tip 54T. As previously described, extension height H54 is less than extension height H44. Still further, each backup cutting face 54 in each second backup row 56 extends to substantially the same extension height H54' measured perpendicularly from cutter-supporting surface 52 to its outermost cutting tip 54T. In this embodiment, extension height H54' of As previously described, extension height H54' is less than extension height H54. Thus, primary cutting faces 44 will tend to engage the formation before backup cutting faces 54, and backup cutting faces 54 in first backup row 55 will tend to engage the formation before backup cutting faces 54 in second backup row 56.

Referring still to FIG. 7, backup cutting faces 54 in first backup row 55 are "off-profile," each being offset from outermost cutting profile Po by offset distance O54. As previously described, offset distance O54 is preferably less than 0.100 in. (~2.54 mm), and more preferably between 0 and 0.060 in. (~1.524 mm). In addition, backup cutting faces 54 in second backup row 56 are "off-profile," each being offset from cutting profile Po by offset distance O54'. Offset distance O54' is preferably less than 0.100 in. (~2.54 mm), and more preferably between 0 in. and 0.080 in. (~2.032 mm). In some embodiments, offset distance O54' is a function of offset distance O54. The offset ratio for backup cutting faces 54 in each first backup row 55 is preferably between 0.020 and 0.200, and the offset ratio for backup cutting faces 54 in each second backup row 56 is preferably between 0.020 and 0.200.

Each backup cutting face 54 in each backup row 55 is redundant to and disposed at the same radial position as a corresponding primary cutting face 44 in primary row 45 on the same blade 31-38. Further, each backup cutting face 54 in each backup row 56 is redundant to and disposed at the same radial position as a corresponding backup cutting face 54 in backup row 55 on the same blade 35-38. As a result of the relative sizes and radial positions of primary cutting faces 44 and backup cutting faces 54, the cutting profile or path of each backup cutting face 54 in each backup row 55 is completely eclipsed or overlapped by the cutting profile or path of its associated primary cutting face 44, and the cutting profile or path of each backup cutting face 54 in each backup row 56 is completely eclipsed or overlapped by the cutting profile or path of its associated backup cutting face 54 in backup row 55. However, in an effort to maximize bottomhole coverage, in regions 24, 25, primary cutting faces 44 on blades 31-38 are staggered relative to each other, each being disposed at a different and unique radial position relative to bit axis 11 in rotated profile view. Accordingly, in regions 24, 25, each primary cutting face 44 is disposed at a unique profile angle.

In this embodiment, each primary cutting face 44 has substantially the same size and geometry, and each backup cutting face 54 has substantially the same size and geometry. Further, in this embodiment, each primary cutting face 44 and each backup cutting face 54 has substantially the same diameter d. Although cutting faces 44, 54 in regions 24, 25 are each disposed in different radial positions, due to their relative sizes and positions, cutting faces 44, 54 at least partially overlap with one or more adjacent cutting face 44, 54 in rotated profile view, thereby offering the potential to enhance the bottomhole coverage of bit 10, and reduce the formation of uncut ridges between adjacent cutter elements in rotated profile.

Figure 8:
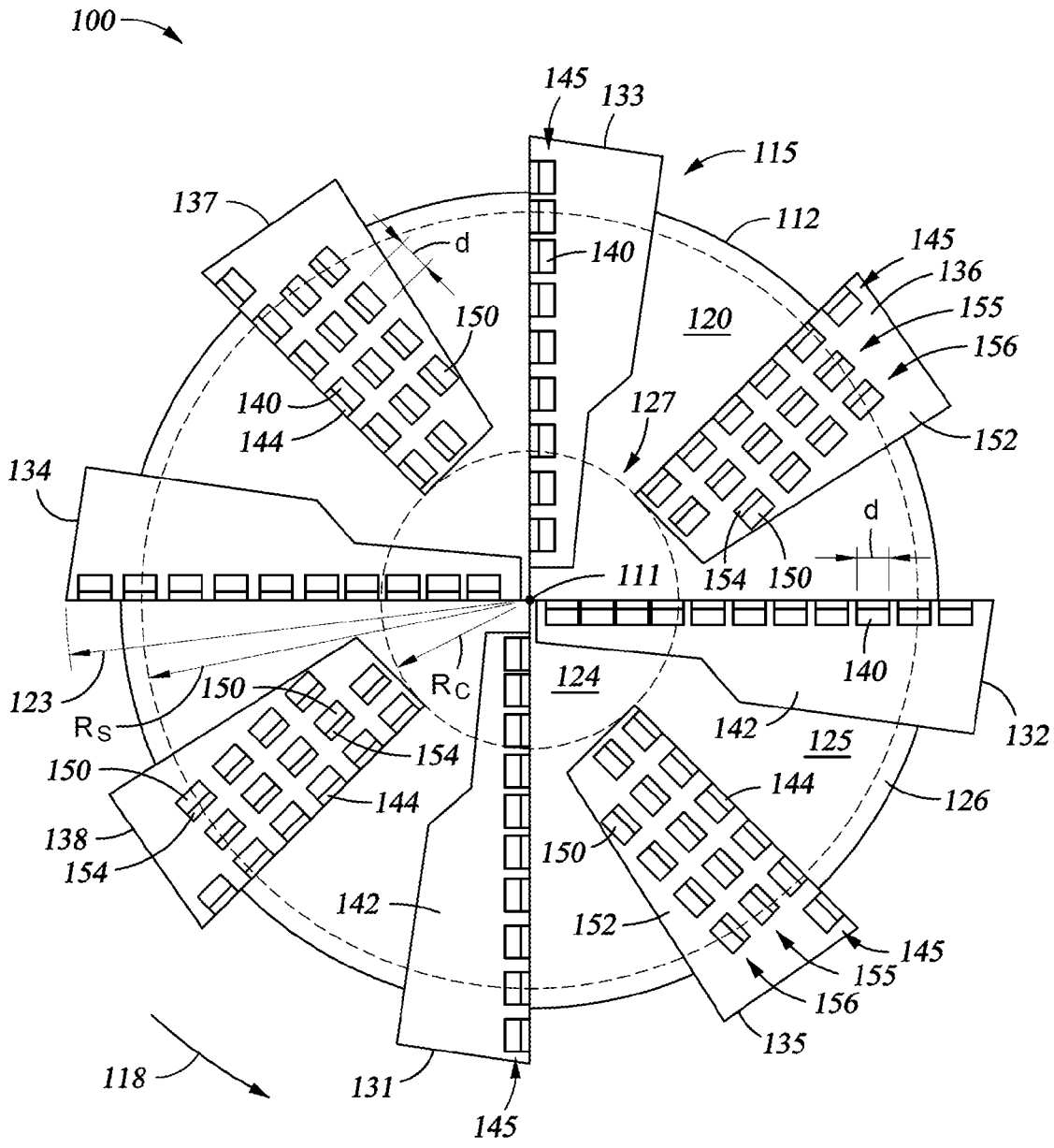
FIG. 8 is a schematic top view of an embodiment of a bit made in accordance with the principles described herein.

Referring now to FIG. 8, another embodiment of a fixed cutter bit 100 adapted for drilling through formations of rock to form a borehole is shown. Bit 100 is similar to bit 10 previously described. Namely, bit 100 includes a bit body 112 and a bit face 120 that supports a cutting structure 115. Bit 100 further includes a central axis 111 about which bit 100 rotates in the cutting direction represented by arrow 118.

Moving radially outward from bit axis 111, bit face 120 includes a radially inner cone region 124, a radially intermediate shoulder region 125, and a radially outer gage region 126 similar to region 24, 25, 26, respectively, previously described. Cone region 124 extends radially from bit axis 111 to a cone radius Rc, shoulder region 125 extends radially from cone radius Rc to shoulder radius Rs, and gage region 126 extends radially from shoulder radius Rs to bit outer radius 123. Similar to regions 24, 25, 26, previously described, in this embodiment, cone region 124 is concave, shoulder region 125 is generally convex, and gage region 126 extends substantially parallel to bit axis 111.

Cutting structure 115 includes four primary blades 131-134 circumferentially spaced-apart about bit axis 111, and four secondary blades 135-138 circumferentially spaced-apart about bit axis 111. In this embodiment, blades 131-138 are uniformly angularly spaced on bit face 120 about bit axis 111. Each primary blade 131-134 includes a cutter-supporting surface 142 for mounting a plurality of cutter elements, and each secondary blade 135-138 also includes a cutter-supporting surface 152 for mounting a plurality of cutter elements. Primary blades 131-134 extend radially along bit face 120 from within cone region 124 proximal bit axis 111 toward gage region 126 and outer radius 123. Further, secondary blades 135-138 extend radially along bit face 120 from proximal nose region 127 toward gage region 126 and outer radius 123. In this embodiment, secondary blades 135-138 do not extend into cone region 124.

Referring still to FIG. 8, a plurality of primary cutter elements 140, each having a forward facing primary cutting face 144, are mounted to cutter supporting surface 142, 152 of each primary blade 131-134 and each secondary blade 135-138, respectively. In addition, a plurality of backup cutter elements 150, each having a forward facing backup cutting face 154, are mounted to each secondary blade 135-138. Unlike bit 10 previously described, no backup cutter elements 150 are mounted to any of primary blades 131-134. When bit 100 rotates about central axis 111 in the cutting direction represented by arrow 118, primary cutter elements 140 lead or precede each backup cutter element 150 provided on the same secondary blade 135-138.

Primary cutter elements 140 are arranged adjacent one another in a leading or primary row 145 extending radially along the leading edge of each primary blade 131-134 and along the leading edge of each secondary blade 135-138. A first set or plurality of backup cutter elements 150 are arranged adjacent one another in a first trailing or backup row 155 on each secondary blade 135-138, and a second set or plurality of backup cutter elements 150 are arranged adjacent one another in a second trailing or backup row 156 on each secondary blade 135-138. On each secondary blade 135-138, first backup row 155 trails primary row 145, and second backup row 156 trails first backup row 155.

In this embodiment, each cutter element 140, 150 has substantially the same size and geometry. In particular, each cutting face 144, 154 has substantially the same diameter d. The total backup face surface area on each secondary blade 135-138 (i.e., the sum of the backup face surface areas of all backup cutting face 154 on each particular secondary blade 135-138) is preferably greater than or equal to the total backup face surface area on each primary blade 131-134 (i.e., the sum of the backup face surface areas of all backup cutting face 154 on each particular primary blade 131-134). In this embodiment, no backup cutter elements 150 are provided on any primary blade 131-134 (total backup face surface area on each primary blade 131-134 is zero), and each secondary blade 135-138 has nine backup cutter elements 150. Thus, the total backup face surface area on each secondary blade 135-138 is greater than the total backup face surface area on each primary blade 131-134.

Further, the total backup face surface area on all secondary blades 135-138 (i.e., the sum of the backup face surface areas of all backup faces 154 on all secondary blades 135-138) is preferably greater than or equal to the total backup face surface area on all primary blades 131-134 (i.e., the sum of the backup face surface areas of all backup faces 154 on all primary blades 131-134). In this embodiment, no backup cutter elements 150 are provided on any primary blade 131-134, and thirty-six backup cutter elements 150 are provided on all secondary blades 135-138. Thus, the total backup face surface area on all secondary blades 135-138 is greater than or equal to the total backup face surface area on all primary blades 131-134.

Still further, the total backup face surface area on each secondary blade 135-138 (i.e., the sum of the backup face surface areas of all backup cutting faces 154 on each secondary blade 135-138) is preferably greater than or equal to the total primary face surface area on each secondary blade 135-138 (i.e., the sum of the primary face surface areas of all primary cutting faces 144 on each secondary blade 135-138). In particular, the ratio of the total backup face surface area on each secondary blade 135-138 to the total primary face surface area on each secondary blade 135-138 is preferably greater than or equal to 1.0, more preferably greater than or equal to 1.2, and even more preferably greater than or equal to 1.5. In this embodiment, each secondary blade 135-138 has nine backup cutter elements 150 and six primary cutter elements 140. Since each cutting face 144, 154 has substantially the same diameter d, the total backup face surface area on each secondary blade 135-138 is greater than the total primary face surface area on each secondary blade 135-138. For an exemplary bit 100 having cutting faces 144, 154 with a ~16 mm (0.625 in.) diameter, each cutting face 144, 154 has a face surface area of about 200 mm2 (~0.31 in.2). Thus, for such an exemplary bit 100, the total backup face surface area on each secondary blade 135-138 is about 1800 mm2 (nine backup cutting faces 154 on each secondary blade 135-138 multiplied by 200 mm2 per backup cutting face 154), and the total primary face surface area on each secondary blade 135-138 is about 1200 mm2 (six primary cutting faces 144 on each secondary blade 135-138 multiplied by 200 mm2 per primary cutting face 144). Thus, in this embodiment, the ratio of the total backup face surface area on each secondary blade 135-138 to the total primary face surface area on each secondary blade 135-138 is about 1.50.

Each backup cutting face 154 in each backup row 155 is redundant to and disposed at the same radial position as a corresponding primary cutting face 144 in primary row 145 on the same secondary blade 135-138. Further, each backup cutting face 154 in each backup row 156 is redundant to and disposed at the same radial position as a corresponding backup cutting face 154 in backup row 155 on the same secondary blade 135-138. As a result of the relative sizes and radial positions of primary cutting faces 144 and backup cutting faces 154, the cutting profile or path of each backup cutting face 154 in each backup row 155 is completely eclipsed or overlapped by the cutting profile or path of its associated primary cutting face 144, and the cutting profile or path of each backup cutting face 154 in each backup row 156 is completely eclipsed or overlapped by the cutting profile or path of its associated backup cutting face 154 in backup row 155. However, in an effort to maximize bottomhole coverage, in regions 124, 125, primary cutting faces 144 on blades 131-38 are staggered relative to each other, each being disposed at a different and unique radial position relative to bit axis 111. Accordingly, in regions 124, 125, each primary cutting face 144 is disposed at a unique profile angle.

In this embodiment, each primary cutting face 144 and each backup cutting face 154 has substantially the same diameter d. Although cutting faces 144, 154 in regions 124, 125 are each disposed in different radial positions, due to their relative sizes and positions, cutting faces 144, 154 at least partially overlap with one or more adjacent cutting face 144, 154 in rotated profile view, thereby offering the potential to enhance the bottomhole coverage of bit 100, and reduce the formation of uncut ridges between adjacent cutter elements in rotated profile.

Figure 9:
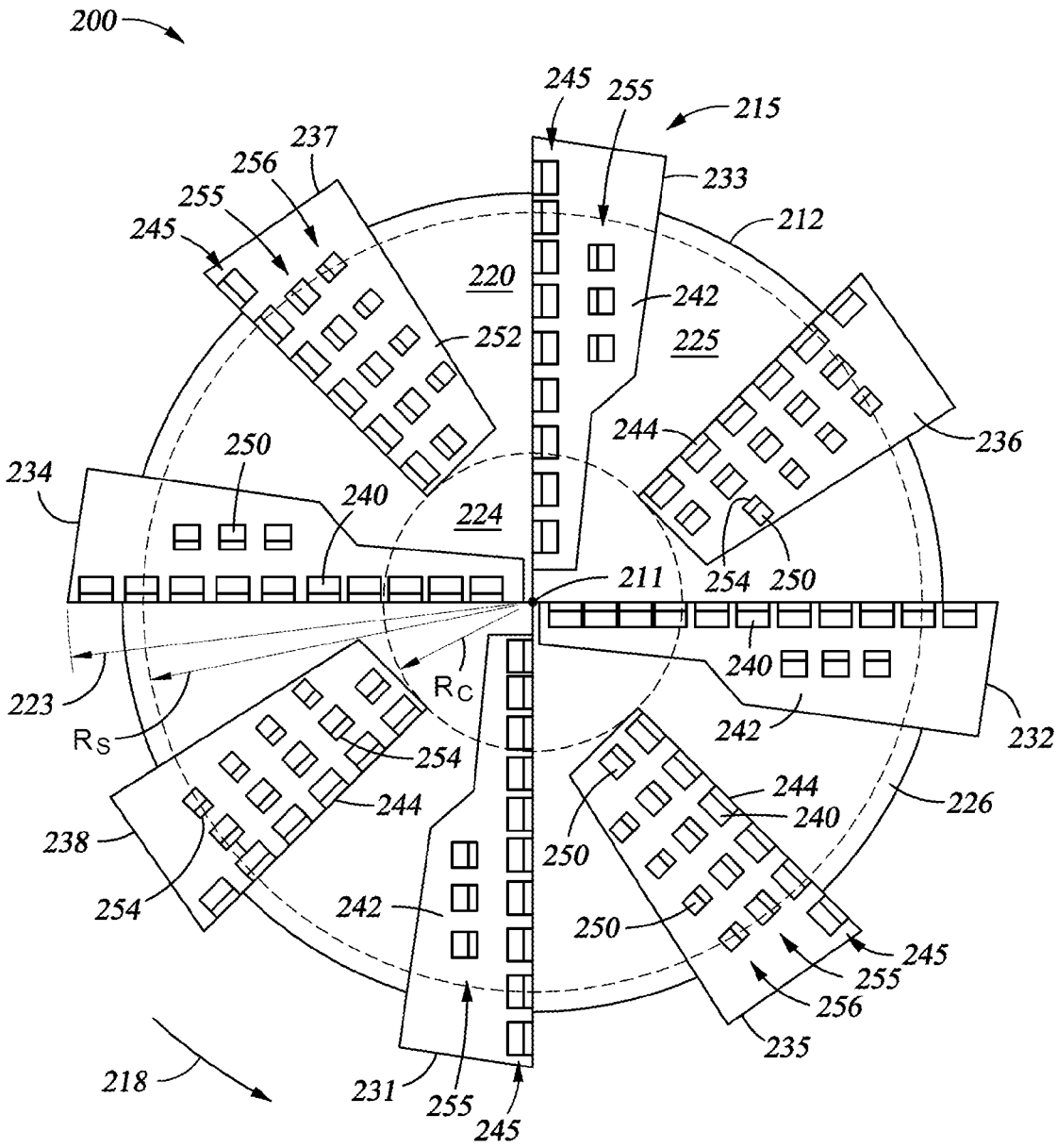
FIG. 9 is a schematic top view of an embodiment of a bit made in accordance with the principles described herein.

Referring now to FIG. 9, another embodiment of a fixed cutter bit 200 adapted for drilling through formations of rock to form a borehole is shown. Bit 200 is similar to bits 10, 100 previously described. Namely, bit 200 includes a bit body 212 and a bit face 220 that supports a cutting structure 215. Bit 200 further includes a central axis 211 about which bit 2100 rotates in the cutting direction represented by arrow 218.

Moving radially outward from bit axis 211, bit face 220 includes a radially inner cone region 224, a radially intermediate shoulder region 225, and a radially outer gage region 226 similar to region 24, 25, 26, respectively, previously described. Cone region 224 extends radially from bit axis 211 to a cone radius Rc, shoulder region 225 extends radially from cone radius Rc to shoulder radius Rs, and gage region 226 extends radially from shoulder radius Rs to bit outer radius 223. Similar to regions 24, 25, 26, previously described, in this embodiment, cone region 224 is concave, shoulder region 225 is generally convex, and gage region 226 extends substantially parallel to bit axis 211.

Cutting structure 215 includes four primary blades 231-234 circumferentially spaced-apart about bit axis 211, and four secondary blades 235-238 circumferentially spaced-apart about bit axis 211. In this embodiment, blades 231-238 are uniformly angularly spaced on bit face 220 about bit axis 211. Each primary blade 231-234 includes a cutter-supporting surface 242 for mounting a plurality of cutter elements, and each secondary blade 235-238 also includes a cutter-supporting surface 252 for mounting a plurality of cutter elements. Primary blades 231-234 extend radially along bit face 220 from within cone region 224 proximal bit axis 211 toward gage region 226 and outer radius 223. Further, secondary blades 235-238 extend radially along bit face 120 from proximal nose region 227 toward gage region 226 and outer radius 223. In this embodiment, secondary blades 235-238 do not extend into cone region 224.

Figure 10:
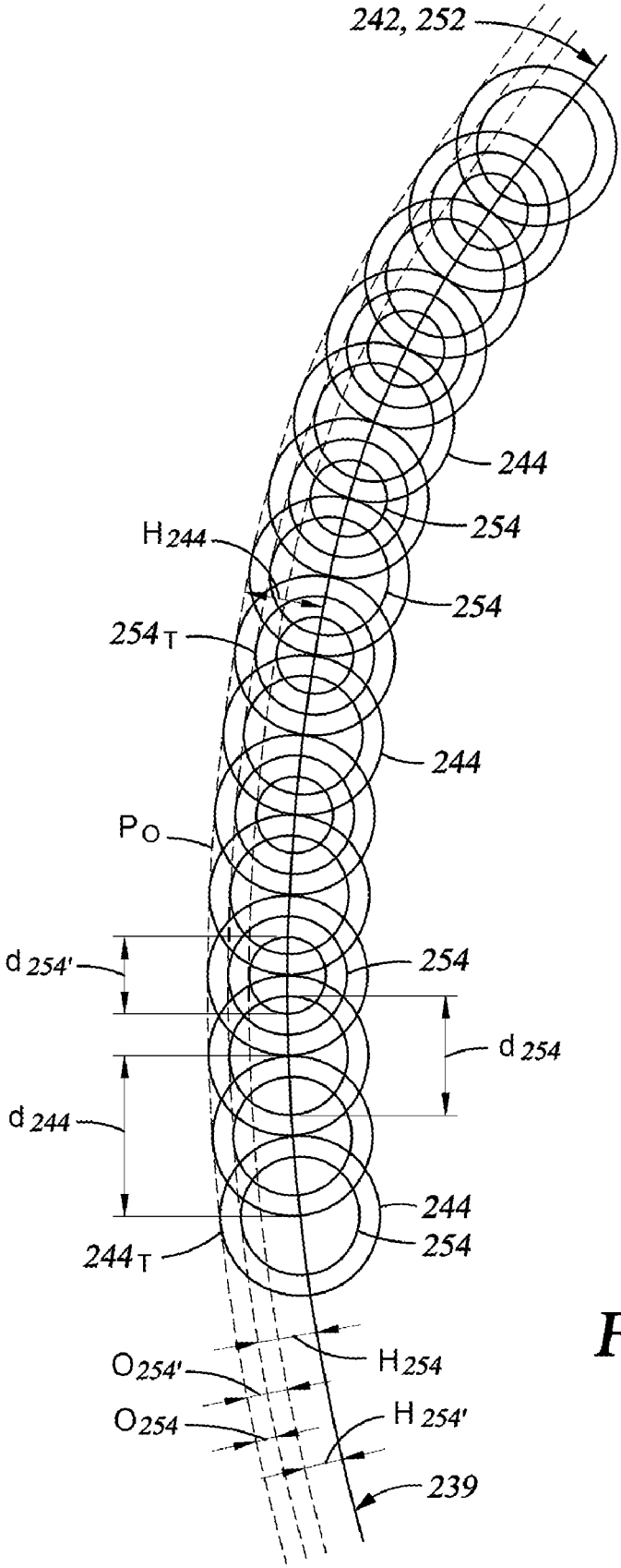
FIG. 10 is a partial composite rotated profile view of the bit shown in FIG. 9.

Referring now to FIGS. 9 and 10, a plurality of primary cutter elements 240, each having a forward facing primary cutting face 244, are mounted to cutter supporting surface 242, 252 of each primary blade 231-234 and each secondary blade 235-238, respectively. In addition, a plurality of backup cutter elements 250, each having a forward facing backup cutting face 254, are mounted to each primary blade 231-234 and to each secondary blade 235-238. When bit 200 rotates about central axis 211 in the cutting direction represented by arrow 218, primary cutter elements 240 lead or precede each backup cutter element 250 provided on the same blade 231-138.

Primary cutter elements 240 are arranged adjacent one another in a leading or primary row 245 extending radially along the leading edge of each primary blade 231-234 and along the leading edge of each secondary blade 235-238. A plurality of backup cutter elements 250 are arranged adjacent one another in a trailing or backup row on each primary blade 231-234. In addition, a first set or plurality of backup cutter elements 250 are arranged adjacent one another in a first trailing or backup row 255 on each secondary blade 235-238, and a second set or plurality of backup cutter elements 250 are arranged adjacent one another in a second trailing or backup row 256 on each secondary blade 235-238. On each primary blade 231-234, backup row 255 trails primary row 245. On each secondary blade 235-238, first backup row 255 trails primary row 245, and second backup row 256 trails first backup row 255.

In this embodiment, each primary cutter element 240 has substantially the same size and geometry, each backup cutter element 250 in each backup row 255 has substantially the same size and geometry, and each backup cutter element 250 in each backup row 256 has substantially the same size and geometry. However, unlike bits 10, 100 previously described, in this embodiment, primary cutter elements 240 do not have the same size as backup cutter elements 250 in backup row 255, and backup cutter elements 250 in backup row 256 do not have the same size as backup cutter elements in backup row 255. In particular, each primary cutting face 244 has substantially the same diameter d244, each backup cutting face 254 in each backup row 255 has substantially the same diameter d254 that is less than diameter d244, and each backup cutting face 254 in each backup row 256 has substantially the same diameter d254' that is less than diameter d254.

The total backup face surface area on each secondary blade 235-238 is preferably greater than or equal to the total backup face surface area on each primary blade 231-234. In particular, the ratio of the total backup face surface area on each secondary blade 35, 36, 37, 38 to the total backup face surface area on each primary blade 31, 32, 33, 34 is preferably greater than or equal to 1.0, more preferably greater than or equal to 1.5, and even more preferably greater than or equal to 2.0. In this embodiment, three backup cutter elements 250 in backup row 255 are provided on each primary blade 231-234, and nine backup cutter elements 250 are provided on each secondary blade 235-238—six backup cutter elements 250 in backup row 255 and three backup cutter elements 250 in backup row 256. Since each backup cutting face 254 in each backup row 255 has substantially the same diameter d254, the total backup face surface area on each secondary blade 235-238 is greater than the total backup face surface area on each primary blade 231-234. For an exemplary bit 10 having backup cutting faces 254 in each backup row 255 with a 14 mm (~0.551 in.) diameter and backup cutting faces 254 in each backup row 256 with a 13 mm (~0.511) diameter, each backup cutting face 254 in each backup row 255 has a backup face surface area of about 154 mm2 and each backup cutting face 254 in each backup row 256 has a backup face surface area of about 133 mm2. Thus, for such an exemplary bit 200, the total backup face surface area on each secondary blade 235-238 is about 1323 mm2 (six backup cutting faces 254 in each backup row 255 on each secondary blade 235-238 multiplied by 154 mm2 plus three backup cutting faces 254 in each backup row 256 on each secondary blade 235-238 multiplied by 133 mm2), and the total backup face surface area on each primary blade 231-234 is about 462 mm2 (three backup cutting faces 254 in each backup row 255 on each primary blade 231-234 multiplied by 154 mm2 per backup cutting face 254 in each backup row 255). Thus, in this embodiment, the ratio of the total backup face surface area on each secondary blade 235-238 to the total backup face surface area on each primary blade 231-234 is about 2.86 (1323 mm2/462 mm2).

Further, the total backup face surface area on all secondary blades 235-238 is preferably greater than or equal to the total backup face surface area on all primary blades 231-234. In this embodiment, twelve backup cutter elements 250 in backup rows 255 are provided on all primary blade 231-234, and thirty-six backup cutter elements 250 are provided on all secondary blades 235-238—twenty-four backup cutter elements 250 on backup rows 255 and twelve backup cutter elements 250 in backup rows 256. Since each backup cutting face 254 in each backup row 255 has substantially the same diameter d254, the total backup face surface area on all secondary blades 235-238 is greater than or equal to the total backup face surface area on all primary blades 231-234. For an exemplary bit 10 having backup cutting faces 254 in each backup row 255 with a 14 mm (~0.551 in.) diameter and backup cutting faces 254 in each backup row 256 with a 13 mm (~0.511) diameter, each backup cutting face 254 in each backup row 255 has a backup face surface area of about 154 mm2 and each backup cutting face 254 in each backup row 256 has a backup face surface area of about 133 mm2. Thus, for such an exemplary bit 200, the total backup face surface area on all secondary blades 235-238 is about 5292 mm2 (twenty-four backup cutting faces 254 in backup rows 255 on all secondary blades 235-238 multiplied by 154 mm2 plus twelve backup cutting faces 254 in backup rows 256 on all secondary blade 235-238 multiplied by 133 mm2), and the total backup face surface area on all primary blades 231-234 is about 1848 mm2 (twelve backup cutting faces 254 in backup rows 255 on all primary blades 231-234 multiplied by 154 mm2). Thus, in this embodiment, the ratio of the total backup face surface area on each secondary blade 235-238 to the total backup face surface area on each primary blade 231-234 is about 2.86 (5292 mm2/1848 mm2).

Still further, the total backup face surface area on each secondary blade 235-238 is preferably greater than or equal to the total primary face surface area on each secondary blade 235-238. In particular, the ratio of the total backup face surface area on each secondary blade 235-238 to the total primary face surface area on each secondary blade 235-238 is preferably greater than or equal to 1.0, more preferably greater than or equal to 1.2, and even more preferably greater than or equal to 1.5. In this embodiment, each secondary blade 235-238 has six primary cutter elements 240, six backup cutter elements 250 in backup row 255, and three backup cutter elements 250 in backup row 256. For an exemplary bit 200 having primary cutting faces 244 with a 16 mm (~0.625 in.) diameter d244, backup cutting faces 254 in backup row 255 with a 14 mm (~0.551 in.) diameter d254, and backup cutting faces 254 in backup row 256 with a 13 mm (~0.512 in.) diameter d254', each primary cutting face 244 has a face surface area of about 200 mm2 (~0.31 in.2), each backup cutting face 254 in backup row 255 has a face surface area of about 154 mm2 (~0.238 in.2), and each backup cutting face 254 in backup row 256 has a face surface area of about 133 mm2 (~0.206 in.2). Thus, for such an exemplary bit 200, the total backup face surface area on each secondary blade 235-238 is about 1323 mm2 (six backup cutting faces 254 on each secondary blade 235-238 in backup row 255 multiplied by 154 mm2 per backup cutting face 254 in backup row 255, plus three backup cutting faces 254 on each secondary blade 235-238 in backup row 256 multiplied by 133 mm 2 per backup cutting face 254 in backup row 256), and the total primary face surface area on each secondary blade 235-238 is about 1200 mm2 (six primary cutting faces 244 on each secondary blade 235-238 multiplied by 200 mm2 per primary cutting face 244). Thus, in this embodiment, the ratio of the total backup face surface area on each secondary blade 235-238 to the total primary face surface area on each secondary blade 235-238 is about 1.103.

Referring now to FIG. 10, the profiles of primary blades 231-234, secondary blades 235-238, and cutting faces 244, 254 are schematically shown rotated into a single composite rotated profile view. For purposes of clarity, only a partial view of the single composite rotated profile is shown. In rotated profile view, each primary blade 231-234 and each secondary blade 235-238 extends along and defines a blade profile 239.

In this embodiment, each primary cutting face 244 extends to substantially the same extension height H244 measured perpendicularly from cutter-supporting surface 242, 252 (or blade profile 239) to its outermost cutting tip 244T. None of cutting tips 244T is eclipsed or covered by another cutting face 244, 254, and thus, each cutting tip 244T defines an outermost cutting profile Po and is "on-profile." In addition, each backup cutting face 254 in each backup row 255 extends to substantially the same extension height H254 measured perpendicularly from cutter-supporting surface 242, 252 to its outermost cutting tip 254T. Extension height H254 is less than extension height H244. Still further, each backup cutting face 254 in each backup row 256 extends to substantially the same extension height H254' measured perpendicularly from cutter-supporting surface 252 to its outermost cutting tip 254T. In this embodiment, extension height H254' is less than extension height H254.

Referring still to FIG. 10, backup cutting faces 154 in each backup row 255 are "off-profile," each being offset from outermost cutting profile Po by offset distance O254 that is preferably less than 0.100 in. (~2.54 mm), and more preferably between 0 and 0.060 in. (~1.524 mm). In addition, backup cutting faces 254 in each backup row 256 are "off-profile," each being offset from cutting profile Po by offset distance O254' that is preferably less than 0.100 in. (~2.54 mm), and more preferably between 0 in. and 0.080 in. (~2.032 mm).

Referring now to FIGS. 9 and 10, each backup cutting face 254 in each backup row 255 is redundant to and disposed at the same radial position as a corresponding primary cutting face 244 in primary row 245 on the same blade 231-238. Further, each backup cutting face 254 in each backup row 256 is redundant to and disposed at the same radial position as a corresponding backup cutting face 254 in backup row 255 on the same blade 235-238. As a result of the relative sizes and radial positions of primary cutting faces 244 and backup cutting faces 254, the cutting profile or path of each backup cutting face 254 in each backup row 255 is completely eclipsed or overlapped by the cutting profile or path of its associated primary cutting face 244, and the cutting profile or path of each backup cutting face 254 in each backup row 256 is completely eclipsed or overlapped by the cutting profile or path of its associated backup cutting face 254 in backup row 255. However, in an effort to maximize bottomhole coverage, in regions 224, 225, primary cutting faces 244 on blades 231-238 are staggered relative to each other, each being disposed at a different and unique radial position relative to bit axis 211 in rotated profile view. Accordingly, in regions 224, 225, each primary cutting face 244 is disposed at a unique profile angle.

As previously described, each primary cutting face 244 has substantially the same size and geometry, and each backup cutting face 254 has substantially the same size and geometry. Further, in this embodiment, each primary cutting face 244 has a diameter d244 that is larger than diameter d254 of each backup cutting face 254. Although cutting faces 244, 254 in regions 224, 225 are each disposed in different radial positions, due to their relative sizes and positions, cutting faces 244, 254 at least partially overlap with one or more adjacent cutting face 244, 254 in rotated profile view, thereby offering the potential to enhance the bottomhole coverage of bit 200, and reduce the formation of uncut ridges between adjacent cutter elements in rotated profile.

While specific embodiments have been shown and described, modifications thereof can be made by one skilled in the art without departing from the scope or teaching herein. The embodiments described herein are exemplary only and are not limiting. For example, embodiments described herein may be applied to any bit layout including, without limitation, single set bit designs where each cutter element has unique radial position along the rotated cutting profile, plural set bit designs where each cutter element has a redundant cutter element in the same radial position provided on a different blade when viewed in rotated profile, forward spiral bit designs, reverse spiral bit designs, or combinations thereof. In addition, embodiments described herein may also be applied to straight blade configurations or helix blade configurations. Many other variations and modifications of the system and apparatus are possible. For instance, in the embodiments described herein, a variety of features including, without limitation, the number of blades (e.g., primary blades, secondary blades, etc.), the spacing between cutter elements, cutter element geometry and orientation (e.g., backrake, siderake, etc.), cutter element locations, cutter element extension heights, cutter element material properties, or combinations thereof may be varied among one or more primary cutter elements and/or one or more backup cutter elements. Accordingly, the scope of protection is not limited to the embodiments described herein, but is only limited by the claims that follow, the scope of which shall include all equivalents of the subject matter of the claims.

What is claimed is:

1. A drill bit for drilling a borehole in earthen formations, the bit comprising:

a bit body having a bit axis and a bit face including a cone region, a shoulder region, and a gage region;

a primary blade extending radially along the bit face from the cone region through the shoulder region to the gage region;

a plurality of primary cutter elements mounted to the primary blade in a primary row, wherein the primary blade is free of backup cutter elements;

a secondary blade extending radially along the bit face from the shoulder region to the gage region;

a plurality of primary cutter elements mounted to the secondary blade in a primary row;

a first plurality of backup cutter elements mounted to the secondary blade in a first backup row that trails the primary row;

a second plurality of backup cutter elements mounted to the secondary blade in a second backup row that trails the first backup row.

2. The drill bit of claim 1 wherein each primary cutter element and each backup cutter element has a radial position relative to the bit axis, and wherein each primary cutter element on the primary blade has a different radial position than each primary cutter element on the secondary blade.

3. The drill bit of claim 2 wherein each backup cutter element in the first backup row is disposed at the same radial position as one of the primary cutter elements on the secondary blade.

4. The drill bit of claim 3 wherein each of the backup cutter elements in the second backup row is disposed at the same radial position as one of the backup cutter elements in the first backup row.

5. The drill bit of claim 1 wherein each primary cutter element includes a primary cutting face and each backup cutter element includes a backup cutting face, each primary cutting face and each backup cutting face being forward facing;

wherein each primary cutting face and each backup cutting face has an extension height; and wherein the extension height of each primary cutter element on the secondary blade is greater than the extension height of each backup cutter element in the first backup row, and the extension height of each backup cutter element in the first backup row is greater than the extension height of each backup cutter element in the second backup row.

6. The drill bit of claim 1 wherein each primary cutter element and each backup cutter element has a backrake angle, and wherein the backrake angle of each backup cutter element in the first backup row is greater than the backrake angle of each primary cutter element on the secondary blade and the backrake angle of each backup cutter element in the second backup row is greater than the backrake angle of each backup cutter element in the first backup row.

7. The drill bit of claim 1 wherein each primary cutting face has substantially the same diameter, each backup cutting face in the first backup row has substantially the same diameter and each backup cutting face in the second backup row has substantially the same diameter; and wherein the diameter of each backup cutting face in the first backup row is less than the diameter of each primary cutting face, and the diameter of each backup cutting face in the second backup row is less than the diameter of each backup cutting face in the first backup row.

8. A drill bit for drilling a borehole in earthen formations, the bit comprising:

a bit body having a bit axis and a bit face including a cone region, a shoulder region, and a gage region;

a primary blade extending radially along the bit face from the cone region through the shoulder region to the gage region;

a plurality of primary cutter elements mounted to the primary blade;

a secondary blade extending along the bit face from the shoulder region to the gage region;

a plurality of primary cutter elements mounted to the secondary blade;

a plurality of backup cutter elements mounted to the secondary blade;

wherein each primary cutter element includes a forward facing primary cutting face and each backup cutter element includes a forward facing backup cutting face;

wherein each primary cutting face has a primary face surface area and each backup cutting face has a backup face surface area;

wherein the total backup face surface area on the secondary blade is greater than the total backup face surface area on the primary blade; and wherein the total backup face surface area on the secondary blade is greater than or equal to the total primary face surface area on the secondary blade.

9. The drill bit of claim 8 wherein the ratio of the total backup face surface area on the secondary blade to the total backup face surface area on the primary blade is greater than 1.5.

10. The drill bit of claim 9 wherein the ratio of the total backup face surface area on the secondary blade to the total backup face surface area on the primary blade is greater than 2.0.

11. The drill bit of claim 8 further comprising:

a plurality of primary blades, each primary blade extending radially along the bit face from the cone region through the shoulder region to the gage region;

a plurality of primary cutter elements mounted to each primary blade;

a plurality of secondary blades, each secondary blade extending along the bit face from the shoulder region to the gage region;

a plurality of primary cutter elements mounted to each secondary blade;

a plurality of backup cutter elements mounted to each secondary blade; and wherein the total backup face surface area on each secondary blade is greater than the total backup face surface area on each primary blade.

12. The drill bit of claim 11 wherein the ratio of the total backup face surface area on all secondary blades to the total backup face surface area on all primary blades is greater than 1.5.

13. The drill bit of claim 11 wherein the ratio of the total backup face surface area on all secondary blades to the total backup face surface area on all primary blades is greater than 2.0.

14. The drill bit of claim 8 wherein the primary cutter elements mounted to the secondary blade are arranged in a primary row, a first of the plurality of backup cutter elements mounted to the secondary blade are arranged in a first backup row that trails the primary row, and a second of the plurality of backup cutter elements mounted to the secondary blade are arranged in a second backup row that trails the first backup row.

15. The drill bit of claim 14 wherein each backup cutter element has a radial position relative to the bit axis, wherein each backup cutter element in the first backup row on the secondary blade is disposed at the same radial position as a corresponding primary cutter element in the primary row of the secondary blade, and each backup cutter element in the second backup row on the secondary blade is disposed at the same radial position as a corresponding backup cutter element in the first backup row on the secondary blade.

16. The drill bit of claim 14 wherein each primary cutting face and each backup cutting face has an extension height, and wherein the extension height of each primary cutter element is greater than the extension height of each backup cutter element.

17. The drill bit of claim 14 wherein each primary cutter element and each backup cutter element has a backrake angle, and wherein the backrake angle of each backup cutter element in the first backup row is greater than the backrake angle of each primary cutter element on the secondary blade, and the backrake angle of each backup cutter element in the second backup row is greater than the backrake angle of each backup cutter element in the first backup row.

18. The drill bit of claim 17 wherein the backrake angle of each backup cutter element in the first backup row is between 10° and 30°, and the backrake angle of each backup cutter element in the second backup row is between 15° and 30°.

19. The drill bit of claim 14 wherein each primary cutting face has substantially the same diameter, each backup cutting face in the first backup row has substantially the same diameter, and each backup cutting in the second backup row has substantially the same diameter.

20. The drill bit of claim 19 wherein the diameter of each primary cutting face and each backup cutting face is substantially the same.

21. The drill bit of claim 19 wherein the diameter of each backup cutting face in the first backup row is less than the diameter of each primary cutting face and the diameter of each backup cutting face in the second backup row is less than the diameter of each backup cutting face in the first backup row.

22. The drill bit of claim 8 wherein each primary cutter element and each backup cutter element has a radial position relative to the bit axis, and wherein each primary cutter element on the primary blade has a different radial position than each primary cutter element on the secondary blade.

23. The drill bit of claim 22 wherein each backup cutter element is disposed at the same radial position as a corresponding primary cutter element on the same blade.

24. The drill bit of claim 8 wherein each cutter element has a radial position relative to the bit axis, and wherein at least one of the backup cutter elements on the secondary blade is disposed at the same radial position as one of the primary cutter elements on the secondary blade.

25. The drill bit of claim 24 wherein at least two backup cutter elements on the secondary blade are disposed at the same radial position as one of the primary cutter elements on the secondary blade.

26. The drill bit of claim 8 wherein each primary cutting face and each backup cutting face has an extension height, and wherein the extension height of each primary cutter element on the secondary blade is greater than the extension height of each backup cutter element on the secondary blade.

27. The drill bit of claim 26 wherein the extension height of each primary cutter element is greater than the extension height of each backup cutter element in the first backup row on the secondary blade, and each backup cutter element in the first backup row on the secondary blade has a greater extension height than each backup cutter element in the second backup row.

28. A drill bit for drilling a borehole in earthen formations, the bit comprising:

a bit body having a bit axis and a bit face including a cone region, a shoulder region, and a gage region;

a primary blade extending radially along the bit face from the cone region through the shoulder region to the gage region;

a plurality of primary cutter elements mounted to the primary blade arranged in a primary row;

a plurality of backup cutter elements mounted to the primary blade, wherein the backup cutter elements are arranged to consist essentially of a single backup row that trails the primary row;

a secondary blade extending along the bit face from the shoulder region to the gage region;

a plurality of primary cutter elements mounted to the secondary blade arranged in a primary row;

a first plurality of backup cutter elements mounted to the secondary blade, wherein the first plurality of backup cutter elements are arranged in a first backup row that trails the primary row;

a second plurality of backup cutter elements mounted to the secondary blade, wherein the second plurality of backup cutter elements are arranged in a second backup row that trails the first backup row.

29. The drill bit of claim 28 wherein each primary cutter element and each backup cutter element has a radial position relative to the bit axis, and wherein each primary cutter element has a unique radial.

30. The drill bit of claim 29 wherein each of the first plurality of backup cutter elements on the secondary blade is disposed at the same radial position as one of the primary cutter elements on the secondary blade and each of the second plurality of backup cutter elements on the secondary blade is disposed at the same radial position as one of the first plurality of backup cutter elements on the secondary blade.

31. The drill bit of claim 28 wherein each primary cutter element includes a primary cutting face and each backup cutter element includes a backup cutting face; and wherein each primary cutting face and each backup cutting face is forward facing; and wherein each primary cutting face and each backup cutting face has an extension height, and wherein the extension height of each primary cutter element is greater than the extension height of each backup cutter element.

32. The drill bit of claim 28 wherein each primary cutter element includes a primary cutting face and each backup cutter element includes a backup cutting face; and wherein each primary cutting face and each backup cutting face is forward facing; and wherein each primary cutting face and each backup cutting face has an extension height, and wherein the extension height of each primary cutter element is greater than the extension height of each backup cutter element in the first backup row on the secondary blade and the extension height of each backup cutter element in the first backup row on the secondary blade is greater than the extension height of each backup cutter element in the second backup row.

33. The drill bit of claim 28 wherein each primary cutter element and each backup cutter element has a backrake angle, and wherein the backrake angle of each backup cutter element in the first backup row is greater than the backrake angle of each primary cutter element on the secondary blade and the backrake angle of each backup cutter element in the second backup row is greater than the backrake angle of each backup cutter element in the first backup row.

34. The drill bit of claim 28 wherein each primary cutting face has a primary face surface area and each backup cutting face has a backup face surface area; and wherein the total backup face surface area on the secondary blade is greater than the total backup face surface area on the primary blade.

35. The drill bit of claim 34 wherein the ratio of the total backup face surface area on the secondary blade to the total backup face surface area on the primary blade is greater than 1.5.

36. The drill bit of claim 34 further comprising:

a plurality of primary blades, each primary blade extending radially along the bit face from the cone region through the shoulder region to the gage region;

a plurality of primary cutter elements mounted to each primary blade;

a plurality of secondary blades, each secondary blade extending along the bit face from the shoulder region to the gage region;

a plurality of primary cutter elements mounted to each secondary blade;

a plurality of backup cutter elements mounted to each secondary blade; and wherein the total backup face surface area on each secondary blade is greater than the total backup face surface area on each primary blade.

37. The drill bit of claim 36 wherein the total backup face surface area on all secondary blades is greater than the total backup face surface area on all primary blades.

38. The drill bit of claim 37 wherein the ratio of the total backup face surface area on all secondary blades to the total backup face surface area on all primary blades is greater than 1.5.

39. A drill bit for drilling a borehole in earthen formations, the bit comprising:

a bit body having a bit axis and a bit face including a cone region, a shoulder region, and a gage region;

a plurality of primary blades, each primary blade extending radially along the bit face from the cone region through the shoulder region to the gage region;

a plurality of primary cutter elements mounted to each primary blade;

a plurality of secondary blades, each secondary blade extending along the bit face from the shoulder region to the gage region;

a plurality of primary cutter elements mounted to each secondary blade;

a plurality of backup cutter elements mounted to each secondary blade;

wherein each primary cutter element includes a forward facing primary cutting face and each backup cutter element includes a forward facing backup cutting face;

wherein each primary cutting face has a primary face surface area and each backup cutting face has a backup face surface area; and wherein the total backup face surface area of each secondary blade is greater than the total backup face surface area of each primary blade.

40. The drill bit of claim 39 wherein the ratio of the total backup face surface area of each secondary blade to the total backup face surface area of each primary blade is greater than 1.5.

41. The drill bit of claim 39 wherein the ratio of the total backup face surface area of each secondary blade to the total backup face surface area of each primary blade is greater than 2.0.

42. The drill bit of claim 39 wherein the ratio of the total backup face surface area on all secondary blades to the total backup face surface area on all primary blades is greater than 1.5.

43. The drill bit of claim 39 wherein the ratio of the total backup face surface area on all secondary blades to the total backup face surface area on all primary blades is greater than 2.0.

44. The drill bit of claim 39 wherein the primary cutter elements mounted to at least one secondary blade are arranged in a primary row, a first set of the plurality of backup cutter elements mounted to the at least one secondary blade are arranged in a first backup row that trails the primary row, and a second set of the plurality of backup cutter elements mounted to the at least one secondary blade are arranged in a second backup row that trails the first backup row.

45. The drill bit of claim 44 wherein the primary cutter elements mounted to each secondary blade are arranged in a primary row, a first set of the plurality of backup cutter elements mounted to each secondary blade are arranged in a first backup row that trails the primary row, and a second set of the plurality of backup cutter elements mounted to each secondary blade are arranged in a second backup row that trails the first backup row.

46. The drill bit of claim 44 wherein each backup cutter element has a radial position relative to the bit axis, wherein each backup cutter element in the first backup row on the at least one secondary blade is disposed at the same radial position as a corresponding primary cutter element in the primary row of the at least one secondary blade, and each backup cutter element in the second backup row on the at least one secondary blade is disposed at the same radial position as a corresponding backup cutter element in the first backup row on the at least one secondary blade.

47. The drill bit of claim 44 wherein the extension height of each primary cutter element on the at least one secondary blade is greater than the extension height of each backup cutter element in the first backup row on the at least one secondary blade, and each backup cutter element in the first backup row on the at least one secondary blade has a greater extension height than each backup cutter element in the second backup row.

48. The drill bit of claim 44 wherein each primary cutter element and each backup cutter element has a backrake angle, and wherein the backrake angle of each backup cutter element in the first backup row is greater than the backrake angle of each primary cutter element on the at least one secondary blade, and the backrake angle of each backup cutter element in the second backup row is greater than the backrake angle of each backup cutter element in the first backup row.

49. The drill bit of claim 48 wherein the backrake angle of each backup cutter element in the first backup row is between 10° and 30°, and the backrake angle of each backup cutter element in the second backup row is between 15° and 30°.

50. The drill bit of claim 44 wherein each primary cutting face has substantially the same diameter, each backup cutting face in the first backup row has substantially the same diameter, and each backup cutting in the second backup row has substantially the same diameter.

51. The drill bit of claim 50 wherein the diameter of each primary cutting face and each backup cutting face is substantially the same.

52. The drill bit of claim 50 wherein the diameter of each backup cutting face in the first backup row is less than the diameter of each primary cutting face and the diameter of each backup cutting face in the second backup row is less than the diameter of each backup cutting face in the first backup row.

53. The drill bit of claim 39 wherein each primary cutter element and each backup cutter element has a radial position relative to the bit axis, and wherein each primary cutter element on the primary blades has a different radial position than each primary cutter element on the secondary blades.

54. The drill bit of claim 53 wherein each backup cutter element is disposed at the same radial position as a corresponding primary cutter element on the same blade.

55. The drill bit of claim 39 wherein at least two backup cutter elements on at least one of the secondary blades are disposed at the same radial position as one of the primary cutter elements on the at least one secondary blade.

56. The drill bit of claim 39 wherein each primary cutting face and each backup cutting face has an extension height, and wherein the extension height of each primary cutter element is greater than the extension height of each backup cutter element.

57. A drill bit for drilling a borehole in earthen formations, the bit comprising:

a bit body having a bit axis and a bit face including a cone region, a shoulder region, a nose region, and a gage region;

a plurality of primary blades, each primary blade extending radially along the bit face from the cone region through the shoulder region to the gage region;

a plurality of primary cutter elements mounted to each primary blade;

a plurality of secondary blades, each secondary blade extending along the bit face from the shoulder region to the gage region;

a plurality of primary cutter elements mounted to each secondary blade;

a plurality of backup cutter elements mounted to each secondary blade;

wherein each primary cutter element includes a forward facing primary cutting face and each backup cutter element includes a forward facing backup cutting face;

wherein each primary cutting face has a primary face surface area and each backup cutting face has a backup face surface area;

wherein at least one cutter element in the gage region or in the shoulder region proximate the gage region is positioned on each of the plurality of secondary blades which extends to an outermost cutting profile; and wherein the total backup face surface area of the plurality of secondary blades is greater than the total backup face surface area of the plurality of primary blades.

58. The drill bit of claim 57 wherein a plurality of cutter elements in the gage region or in the shoulder region proximate the gage region are positioned on each of the plurality of secondary blades which extend to an outermost cutting profile.

59. The drill bit of claim 57 wherein each of the primary cutter elements in the gage region and the shoulder region are positioned on each of the plurality of secondary blades which extend to an outermost cutting profile.

60. The drill bit of claim 57 wherein the ratio of the total backup face surface area of each secondary blade to the total backup face surface area of each primary blade is greater than 1.5.

61. The drill bit of claim 57 wherein the ratio of the total backup face surface area of each secondary blade to the total backup face surface area of each primary blade is greater than 2.0.

62. The drill bit of claim 57 wherein the ratio of the total backup face surface area on all secondary blades to the total backup face surface area on all primary blades is greater than 1.5.

63. The drill bit of claim 57 wherein the ratio of the total backup face surface area on all secondary blades to the total backup face surface area on all primary blades is greater than 2.0.

64. The drill bit of claim 57 wherein the primary cutter elements mounted to at least one secondary blade are arranged in a primary row, a first set of the plurality of backup cutter elements mounted to the at least one secondary blade are arranged in a first backup row that trails the primary row, and a second set of the plurality of backup cutter elements mounted to the at least one secondary blade are arranged in a second backup row that trails the first backup row.

65. The drill bit of claim 64 wherein the primary cutter elements mounted to each secondary blade are arranged in a primary row, a first set of the plurality of backup cutter elements mounted to each secondary blade are arranged in a first backup row that trails the primary row, and a second set of the plurality of backup cutter elements mounted to each secondary blade are arranged in a second backup row that trails the first backup row.

66. The drill bit of claim 64 wherein each backup cutter element has a radial position relative to the bit axis, wherein each backup cutter element in the first backup row on the at least one secondary blade is disposed at the same radial position as a corresponding primary cutter element in the primary row of the at least one secondary blade, and each backup cutter element in the second backup row on the at least one secondary blade is disposed at the same radial position as a corresponding backup cutter element in the first backup row on the at least one secondary blade.

67. The drill bit of claim 64 wherein the extension height of each primary cutter element on the at least one secondary blade is greater than the extension height of each backup cutter element in the first backup row on the at least one secondary blade, and each backup cutter element in the first backup row on the at least one secondary blade has a greater extension height than each backup cutter element in the second backup row.

68. The drill bit of claim 64 wherein each primary cutter element and each backup cutter element has a backrake angle, and wherein the backrake angle of each backup cutter element in the first backup row is greater than the backrake angle of each primary cutter element on the at least one secondary blade, and the backrake angle of each backup cutter element in the second backup row is greater than the backrake angle of each backup cutter element in the first backup row.

69. The drill bit of claim 68 wherein the backrake angle of each backup cutter element in the first backup row is between 10° and 30°, and the backrake angle of each backup cutter element in the second backup row is between 15° and 30°.

70. The drill bit of claim 64 wherein each primary cutting face has substantially the same diameter, each backup cutting face in the first backup row has substantially the same diameter, and each backup cutting in the second backup row has substantially the same diameter.

71. The drill bit of claim 70 wherein the diameter of each primary cutting face and each backup cutting face is substantially the same.

72. The drill bit of claim 70 wherein the diameter of each backup cutting face in the first backup row is less than the diameter of each primary cutting face and the diameter of each backup cutting face in the second backup row is less than the diameter of each backup cutting face in the first backup row.

73. The drill bit of claim 57 wherein each primary cutter element and each backup cutter element has a radial position relative to the bit axis, and wherein each primary cutter element on the primary blades has a different radial position than each primary cutter element on the secondary blades.

74. The drill bit of claim 73 wherein each backup cutter element is disposed at the same radial position as a corresponding primary cutter element on the same blade.

75. The drill bit of claim 57 wherein at least two backup cutter elements on at least one of the secondary blades are disposed at the same radial position as one of the primary cutter elements on the at least one secondary blade.

76. The drill bit of claim 57 wherein each primary cutting face and each backup cutting face has an extension height, and wherein the extension height of each primary cutter element is greater than the extension height of each backup cutter element.

* * * * *